US007563085B2

(12) United States Patent
Sakaniwa et al.

(10) Patent No.: US 7,563,085 B2
(45) Date of Patent: Jul. 21, 2009

(54) MULTICYLINDER ROTARY COMPRESSOR AND COMPRESSING SYSTEM AND REFRIGERATING UNIT PROVIDED WITH SAME

(75) Inventors: Masazumi Sakaniwa, Gunma (JP); Akira Hashimoto, Gunma (JP); Masayuki Hara, Gunma (JP); Takahiro Nishikawa, Gunma (JP); Hirotsugu Ogasawara, Gunma (JP); Akihiro Suda, Gunma (JP)

(73) Assignee: Sanyo Electric Co., Ltd., Osaka (JP)

( * ) Notice: Subject to any disclaimer, the term of this patent is extended or adjusted under 35 U.S.C. 154(b) by 518 days.

(21) Appl. No.: 11/079,929

(22) Filed: Mar. 14, 2005

(65) Prior Publication Data

US 2005/0214137 A1 Sep. 29, 2005

(30) Foreign Application Priority Data

Mar. 15, 2004 (JP) ..... 2004-073229
Jun. 29, 2004 (JP) ..... 2004-191210

(51) Int. Cl.
*F03C 2/00* (2006.01)

(52) U.S. Cl. ..... 418/60; 418/23; 418/24; 418/11

(58) Field of Classification Search ..... 418/15, 418/22, 23, 24, 60, 62, 63, 65, 11
See application file for complete search history.

(56) References Cited

U.S. PATENT DOCUMENTS 4,780,067 A * 10/1988 Suzuki et al. ..... 418/60
5,013,217 A * 5/1991 Hitosugi ..... 417/26
5,170,636 A 12/1992 Hitosugi et al.
6,796,773 B1 * 9/2004 Choi et al. ..... 418/60
7,290,994 B2 * 11/2007 Kitaichi et al. ..... 418/60
2004/0009083 A1 1/2004 Kim et al.
2006/0002809 A1 * 1/2006 Kawabe et al. ..... 418/63
2007/0154329 A1 7/2007 Onoda
2008/0298993 A1 * 12/2008 Nishikawa et al. ..... 418/60

FOREIGN PATENT DOCUMENTS

JP 62 029788 2/1987
JP 63057889 A * 3/1988
JP 01080790 A * 3/1989
JP 01 247786 10/1989

(Continued)

*Primary Examiner*—Thomas E Denion
*Assistant Examiner*—Mary A Davis
(74) *Attorney, Agent, or Firm*—Weingarten, Schurgin, Gagnebin & Lebovici LLP

(57) ABSTRACT

A compressor includes two rotary compressing elements in a vessel. One of the compressing elements operates while the other element is in a non-operating mode. In the non-operating mode, inflow of refrigerant gas into the cylinder of the rotary compressing element is blocked and a suction side pressure of the rotary compressing element is applied as a back pressure to a vane. A compressing system includes the compressor and a controller and operates in first and second operation modes. In the first operation mode, refrigerant gas flows into a cylinder and an intermediate pressure, a result of flow of the refrigerant gas from between a vane and a guide groove into a back pressure portion, between a suction side pressure and a discharge side pressure, is applied as a back pressure to bias the vane against a roller.

4 Claims, 13 Drawing Sheets

FOREIGN PATENT DOCUMENTS

| | | | | |
|---|---|---|---|---|
| JP | 05-99172 | A | | 4/1993 |
| JP | 05 256286 | | | 10/1993 |
| JP | 07-229495 | A | | 8/1995 |
| JP | 10 259787 | | | 9/1998 |
| JP | 10259787 | A | * | 9/1998 |
| WO | WO 2004083642 | A1 | * | 9/2004 |
| WO | WO2005/061901 | A1 | | 7/2005 |

* cited by examiner first operation mode (two cylinder operation)

second operation mode (one cylinder operation)

one cylinder operation

MULTICYLINDER ROTARY COMPRESSOR AND COMPRESSING SYSTEM AND REFRIGERATING UNIT PROVIDED WITH SAME

This application claims priority to Japanese application No. 2004-073229 filed Mar. 15, 2004, and Japanese application No. 2004-191210 filed Jun. 29, 2004.

BACKGROUND OF THE INVENTION

1. Field of the Invention

The present invention relates to a multicylinder rotary compressor, and more specifically it relates to a multicylinder rotary compressor, which is adapted to operate a plurality of rotary compressing elements during high rotation speed and to operate only one rotary compressing element during low rotation speed, and a compressing system and a refrigerating unit provided with the multicylinder rotary compressor respectively.

2. Description of the Related Art

A rotary compressor, which is a compressor for compressing a refrigerant gas used in an air-conditioner, a refrigerator or the like and has a structure in which two rotary compressing elements are disposed at upper and lower portions, has been known. There is a rotary compressor, which simultaneously compresses the refrigerant gas with two rotary compressing elements, discharges the compressed refrigerant gas into a closed vessel and takes out the compressed refrigerant gas through a discharge pipe provided in the closed vessel. The rotary compressor is referred to as a two-cylinder rotary compressor hereinbelow. Further, there is another rotary compressor in which a motor-operating element provided in a closed vessel is an inverter type and the number of revolutions of a rotating shaft, which rotates through a rotor of the motor-operating element can be varied in accordance with the output. This compressor is disclosed in for example Japanese Patent Laid-Open Publication No. 07-229495.

The above-mentioned conventional two-cylinder rotary compressor will be described schematically. For example, as shown in FIG. 3, the two-cylinder rotary compressor comprises a motor-operating element B and a rotary compressing element C in a closed vessel A so that the motor-operating element B and the rotary compressing element C are positioned at upper and lower portions respectively. The rotary compressing element C includes a first rotary compressing element C1 and a second rotary compressing element C2. A vane E1 abuts on a roller D1, which eccentrically rotates in a compressing chamber in the first rotary compressing element C1 with the vane E1 biased by a spring F1, resulting in that the vane E1 defines between a low pressure chamber and a high pressure chamber in the compressing chamber. Similarly, a vane E2 abuts on a roller D2, which eccentrically rotates in a compressing element C2 with the vane E2 biased by a spring F2, resulting in that the vane E2 defines between a low pressure chamber and a high pressure chamber. The refrigerant gas compressed in the compressing chamber in the first rotary compressing element C1 and the refrigerant gas compressed in the compressing chamber in the second rotary compressing element C2 are discharged into the closed vessel A.

In the above-mentioned two cylinder rotary compressor, a through hole G1 is provided in the first rotary compressing element C1, through which a part of high-pressure refrigerant gas discharged into the closed vessel A is passed to apply back pressure to the vane E1. Thus, by the addition of the back-pressure to a biasing force of the spring F1, the vane E1 is adapted to be in intimate contact with the roller D1. Also, a through hole G2 is provided in the second rotary compressing element C2, through which a part of high-pressure refrigerant gas discharged into the closed vessel A is passed to apply back pressure to the vane E2. Thus, by the addition of the back-pressure to a biasing force of the spring F2, the vane E2 is adapted to be in intimate contact with the roller D2.

Further, a compressing system provided with a conventional multicylinder rotary compressor is comprised of a multicylinder rotary compressor, a control device, which controls an operation of the multicylinder rotary compressor, and the like. And when a driving element is driven by the control device, a low pressure gas is sucked into the respective low pressure chamber sides of the cylinders in the first rotary compressing element and the second rotary compressing element from a suction passage and is respectively compressed by the operations of each roller and each vane to be high pressure refrigerant gas. Then the high pressure refrigerant gas is discharged from the high pressure chamber sides of the respective cylinders to a discharge muffling chamber through a discharge port and then is discharged into the closed vessel A and is then discharged outside. The structure of the compressing system provided with the conventional multicylinder rotary compressor is disclosed in Japanese Patent Laid-Open Publication No. 05-99172, for example.

In the above-mentioned conventional two cylinder rotary compressor, since the motor-operating element B is an inverter type and the number of revolutions of the rotating shaft H is controlled, an operation over a wide range between the a low rotation speed and a high rotation speed can be made. However, when designing is generally carried out so that properties in a wide operation range can be ensured, the COP (coefficient of performance) during operation, which requires a low refrigerating capacity, is lowered by downs of the motor efficiency and pump efficiency during a low rotation speed.

SUMMARY OF THE INVENTION

The present invention was made to solve the problems in such prior arts, and a first object of the present invention is to provide a multicylinder rotary compressor, which uses an inverter type motor-operating element and suppresses a decrease in COP during low rotation speed.

As a means for attaining the above-mentioned first object, a multicylinder rotary compressor according to the first aspect, wherein a rotary compressing element is provided in a closed vessel, said rotary compressing element including at least two rotary compressing elements, is characterized in that said both rotary compressing elements are operated during high rotation speed, and only any one of the rotary compressing elements is operated during low rotation speed so that the other rotary compressing element is made in a non-operation mode.

The multicylinder rotary compressor according to the second aspect, is characterized in that in the multicylinder rotary compressor according to the first aspect, said closed vessel is provided with a refrigerant gas switching means, said both rotary compressing elements are operated during high rotation speed by said refrigerant gas switching means, and only any one of the rotary compressing elements is operated during low rotation speed while the other rotary compressing element is in a non-operation mode.

The multicylinder rotary compressor according to the third aspect, is characterized in that in the multicylinder rotary compressor according to the second aspect, said refrigerant gas switching means is comprised of a communicating pipe attached to the outside of the closed vessel so that one end of the communicating pipe is opened into said closed vessel and the other end of the communicating pipe is opened in a back pressure portion of a vane provided with no spring in any one of said two rotary compressing elements, and an open/close valve provided in a midway portion of said communicating pipe.

The multicylinder rotary compressor according to the fourth aspect, wherein a rotary compressing element is provided in a closed vessel, said rotary compressing element including a first compressing element and a second compressing element, is characterized in that a communicating pipe one end of which is opened into said closed vessel and the other end of which is opened in a back pressure portion of a vane in said second rotary compressing element is provided, a branch pipe is provided in a midway portion of the communicating pipe with a three-way valve attached to a branch point of the branch pipe, high pressure refrigerant gas in said closed vessel is introduced to a back pressure portion of said vane provided with no spring in said second rotary compressing element by switching said three-way valve during high rotation speed to press said vane on a roller whereby said second rotary compressing element is operated, said three-way valve is switched during low rotation speed to relieve the high pressure refrigerant gas in the closed vessel to said branch pipe through said communicating pipe to shut off the introduction of the high pressure refrigerant gas into the back pressure portion of the vane in said second rotary compressing element and said second rotary compressing element is made in a non-operation mode without pressing said vane onto said roller to operate only said first rotary compressing element.

The multicylinder rotary compressor according to the fifth aspect, is characterized in that in the multicylinder rotary compressor, according to the fourth aspect, a through hole communicating with the back pressure portion of the vane in said second rotary compressing element is closed with a sealing member.

The multicylinder rotary compressor according to the sixth aspect is characterized in that in multicylinder rotary compressor according to any one of the first to fifth aspects, the number of revolutions of said rotating shaft is increased about two times during said low rotation speed.

According to the first aspect of the invention, in a multicylinder rotary compressor (for example, two-cylinder rotary compressor) provided with at least two rotary compressing elements in the closed vessel, only any one of the rotary compressing elements is rotated during low rotation speed. Thus, the reduction of COP during low rotation speed can be suppressed.

Further, according to the second aspect of the invention, in the multicylinder rotary compressor according to the first aspect, only any one of the rotary compressing elements is operated during low rotation speed by the refrigerant gas switching means provided in the closed vessel so that the other rotary compressing element can be made in a non-operation mode. Thus, the reduction of COP during low rotation speed can be suppressed.

Further, according to the third aspect of the invention, in the multicylinder rotary compressor according to the second aspect, said refrigerant gas switching means can be comprised of a communicating pipe and an open/close valve provided in a midway portion of the communicating pipe, and the open/close valve is opened during high rotation speed to send a high pressure refrigerant gas in the closed vessel to a back pressure portion of a vane with no spring in one rotary compressing element so that an operation mode is made, while during low rotation speed, the open/close valve is closed to shut off the sending of the high pressure refrigerant gas in the closed vessel to the back pressure portion of the vane in one rotary compressing element so that a non-operation mode can be made. Thus, the reduction of COP during low rotation speed can be suppressed.

Further, according to the fourth aspect of the invention, in a multicylinder rotary compressor (for example, two-cylinder rotary compressor) provided with at least two rotary compressing elements in the closed vessel, a communicating pipe is attached to the closed vessel and a branch pipe is provided in this communicating pipe to attach thereto a three-way valve as a refrigerant gas switching means. Accordingly, the three-way valve is switched during high rotation speed to send a high pressure refrigerant gas in the closed vessel to a back pressure portion of a vane with no spring in one rotary compressing element so that an operation mode is made, while during low rotation speed, the three-way valve is switched to relieve the high pressure refrigerant gas in the closed vessel to the branch pipe so that the sending of the high pressure refrigerant gas to the back pressure portion of the vane in one rotary compressing element is shut off and a non-operation mode can be made. Thus, the reduction of COP during low rotation speed can be suppressed.

According to the fifth aspect of the invention, in the multicylinder rotary compressor according to the fourth aspect, since a through hole communicating with the back pressure portion of the vane in said second rotary compressing elements is closed with a sealing member, high pressure refrigerant gas in the closed vessel does not act on the back pressure portion of the vane with no spring in the second rotary compressing element through the through hole during low rotation speed. Accordingly, the non-operation mode of the second rotary compressing element during low rotation speed can be maintained.

According to the sixth aspect of the invention, in the multicylinder rotary compressor according to any one of the first to fifth aspects, since the number of revolutions of said rotating shaft is increased about two times during low rotation speed, the amount of high pressure refrigerant gas taken out of the closed vessel can be increased by only an action of one rotary compressing element.

However, in the second rotary compressing element with no spring during the two-cylinder operation as mentioned above, since the discharge side pressures of both rotary compressing elements, which bias the rollers, have large pressure fluctuation, the follow-up of the vane is deteriorated by the pressure fluctuation and there is a problem that collision noise is generated between the roller and the vane.

On the other hand, although the roller becomes in a free rolling condition in the second rotary compressing element during the one-cylinder operation, since then the same suction side pressure is applied to the pressure in the cylinder and the back pressure of the vane, there is a problem that the vane is protruded into the cylinder by a fluctuation of balance between the both spaces of the cylinder and vane, resulting in that the vane collides with a roller to produce collision noise.

The present invention was made to solve such problems and a second object of the present invention is to provide a compressing system provided with a multicylinder rotary compressor, which is usable by biasing only a vane in a first rotary compressing element against a roller by a spring member to switch between a first operation mode in which both rotary compressing elements perform compression work and a second mode in which substantially only the first rotary compressing element performs compression work, wherein the follow-up of the vane in the second rotary compressing element is improved and the generation of collision noise of the vane is avoided. Further, a third object of the present invention is to provide a refrigerant unit using such a compressing system.

As a mean for attaining the second object, a compressing system provided with a multicylinder rotary compressor according to the seventh aspect, said compressing system receiving first and second rotary compressing elements driven by a driving element and a rotating shaft of said driving element in a closed vessel, said first and second rotary compressing elements comprising first and second cylinders, first and second rollers fitted in an eccentric portion formed in said rotating shaft, which respectively eccentrically rotate in said respective cylinders, and first and second vanes, which abut on the first and second rollers to define the inside of said respective cylinders between a low pressure chamber side and a high pressure chamber side respectively, and said compressing system being usable by switching a first operation mode in which only said first vane is biased against said first roller by a spring member and said both rotary compressing elements perform compression work and a second operation mode in which substantially only said first rotary compressing element performs compression work, is characterized in that in said first operation mode, an intermediate pressure between a suction side pressure and a discharge side pressure of said both rotary compressing elements is applied as a back pressure of said second vane.

A compressing system provided with a multicylinder rotary compressor according to the eighth aspect, said compressing system receiving first and second rotary compressing elements driven by a driving element and a rotating shaft of said driving element in a closed vessel, said first and second rotary compressing element comprising first and second cylinders, first and second rollers fitted in an eccentric portion formed in said rotating shaft, which respectively eccentrically rotate in said respective cylinders, and first and second vanes, which abut on the first and second rollers to define the inside of said respective cylinders between a low pressure chamber side and a high pressure chamber side respectively, and said compressing system being usable by switching a first operation mode in which only said first vane is biased against said first roller by a spring member and said both rotary compressing elements perform compression work and a second operation mode in which substantially only the first rotary compressing element performs compression work, is characterized in that a valve unit for controlling a refrigerant flow into said second cylinder; and in said second operation mode, the inflow of the refrigerant into said second cylinder is blocked by said valve unit and at the same time a suction side pressure of said first rotary compressing element is applied as a back pressure of said second vane.

Further, a compressing system provided with a multicylinder rotary compressor according to the ninth aspect, said compressing system receiving first and second rotary compressing elements driven by a driving element and a rotating shaft of said driving element in a closed vessel, said first and second rotary compressing element comprising first and second cylinders, first and second rollers fitted in an eccentric portion formed in said rotating shaft, which respectively eccentrically rotate in said respective cylinders, and first and second vanes, which abut on the first and second rollers to define the inside of said respective cylinders between a low pressure chamber side and a high pressure chamber side respectively, and said compressing system being usable by switching a first operation mode in which only said first vane is biased against said first roller by a spring member and said both rotary compressing elements perform compression work and a second operation mode in which substantially only said first rotary compressing element performs compression work, is characterized in that a valve unit for controlling refrigerant flow into said second cylinder; in said first operation mode, a refrigerant is caused to flow into said second cylinder by said valve unit and an intermediate pressure between a suction side pressure and a discharge side pressure of said both rotary compressing elements is applied as a back pressure of said second vane; and in said second operation mode, the inflow of the refrigerant into said second cylinder is blocked by said valve unit and a suction side pressure of said first rotary compressing element is applied as a back pressure of said second vane.

As a means for attaining said third object, a refrigerating unit according to the tenth aspect is characterized in that a refrigerant circuit is formed by use of the compressing system according to any one of the seventh to ninth aspects.

According to the seventh and eighth aspects of the invention, since in the first operation an intermediate pressure between a suction side pressure and a discharge side pressure of both rotary compressing elements is applied as a back pressure of the second vane, the pressure fluctuation remarkably becomes smaller than in case where discharge side pressures of both rotary compressing elements are applied to a back pressure of the second vane. Thus, in the first operation made, the follow-up of the second vane in the multicylinder rotary compressor is improved, a compression efficiency in the second rotary compressing element is improved and the generation of collision noise between the second roller and the second vane can be previously avoided.

According to the eighth and ninth aspects of the invention, in the second operation mode, a valve unit blocks the inflow of refrigerant gas into the second cylinder and at the same time the pressure in the second cylinder can be more increased than the back pressure of the second vane by applying a suction side pressure of the first rotary compressing element as the back pressure of the second vane. Consequently, since in the second operation mode, the second vane of the multicylinder rotary compressor is not protruded into the second cylinder by the pressure in the second cylinder, a disadvantage of producing collision noise due to collision with the second roller can be previously avoided.

As described above, according to the present invention, the performance and reliability of a multicylinder rotary compressor usable by switching between the first operation mode in which the first and second rotary compressing elements perform compression work, and the second operation mode in which substantially only the first rotary compressing element performs compression work are improved so that the remarkable improvement of performance as a compressing system can be effected.

Further, according to the tenth aspect of the invention, a refrigerant circuit of a refrigerating unit is formed by use of the compressing systems of the respective inventions abovementioned and the operation efficiency of the entire refrigerating unit can be improved.

DETAILED DESCRIPTION OF THE PREFERRED EMBODIMENTS

Figure 1:
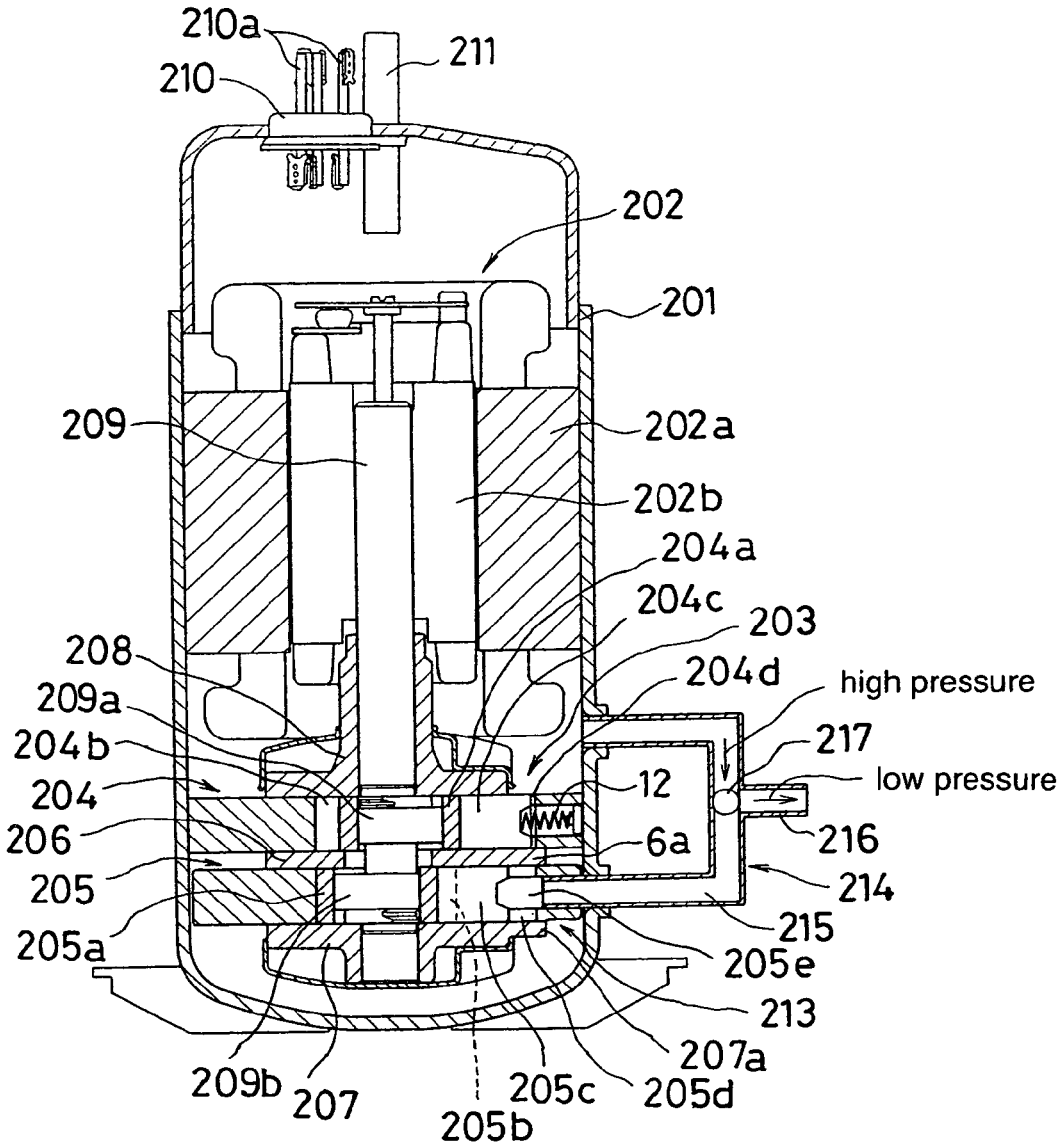
FIG. 1 is a schematic vertical sectional view showing an embodiment in which the present invention is applied to a two-cylinder rotary compressor.
Figure 2:
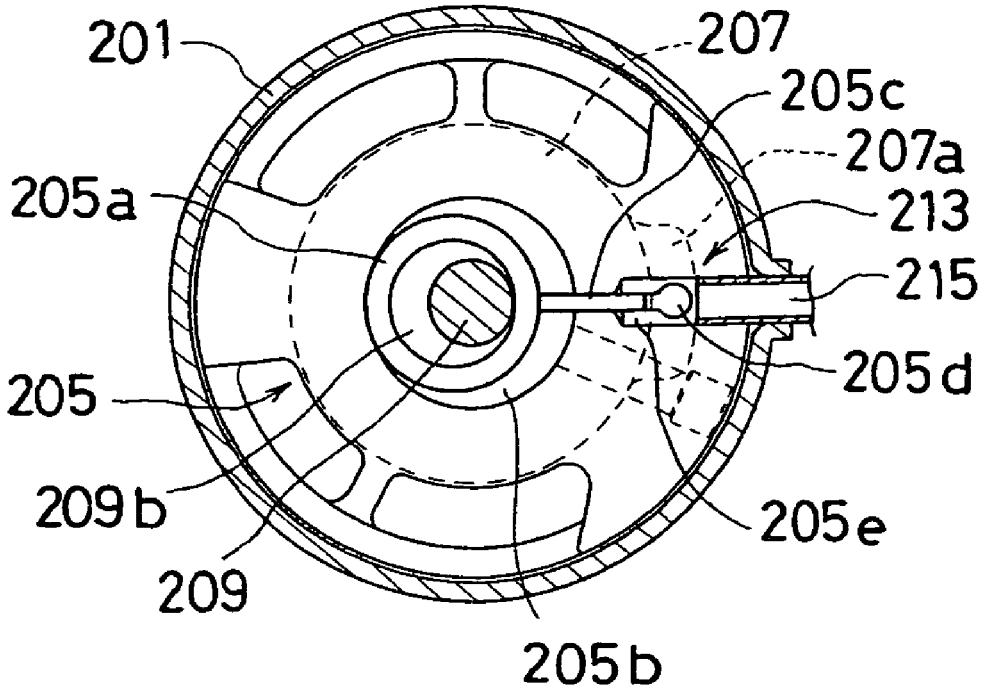
FIG. 2 is a partial schematic cross sectional view of a rotary compressing element in the two-cylinder rotary compressor in FIG. 1.
Figure 3:
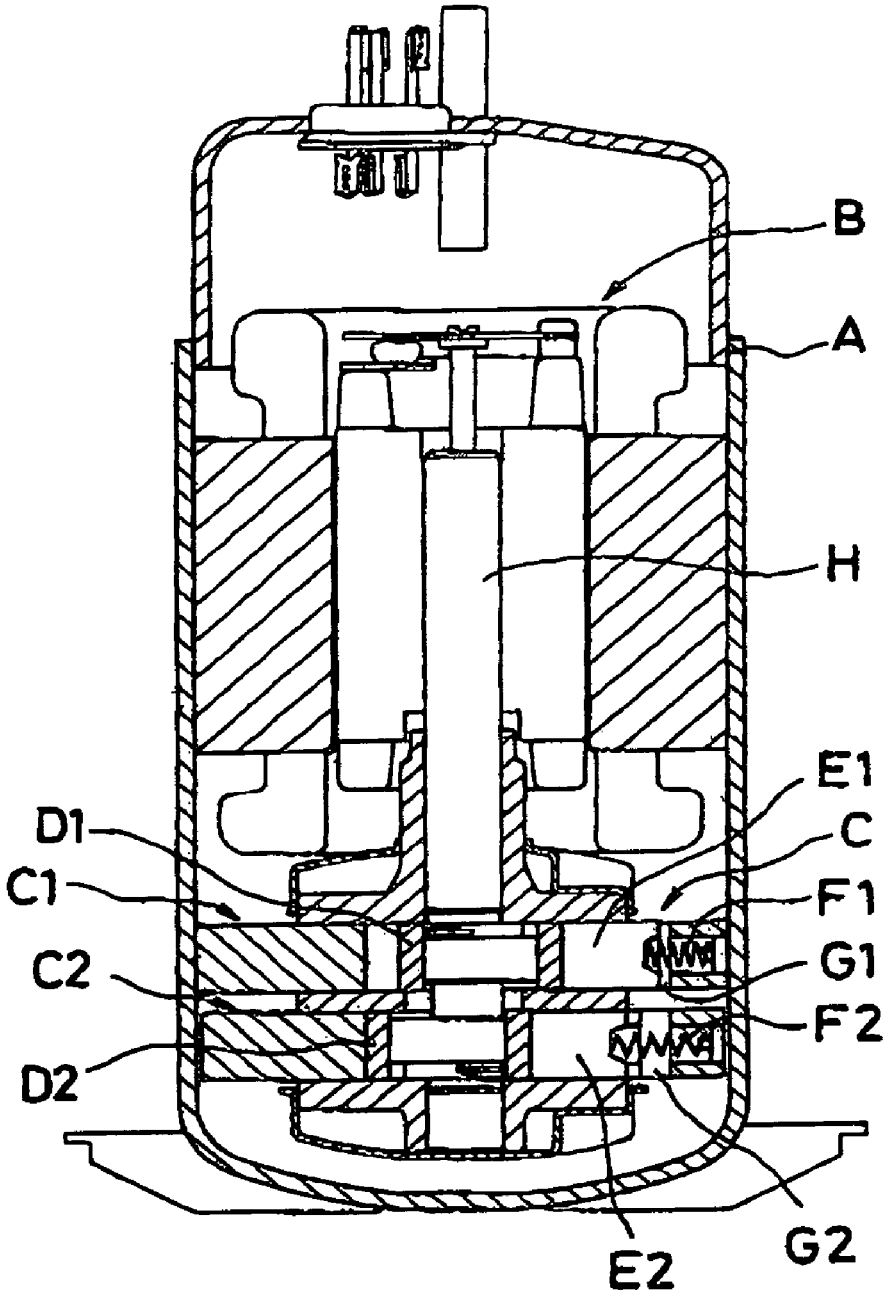
FIG. 3 is a schematic vertical sectional view showing an example of a conventional two-cylinder rotary compressor.

Preferred embodiments of multicylinder rotary compressors according to the present invention will be described with reference to the attached drawings. FIG. 1 is a schematic vertical sectional view showing an embodiment in which the present invention is applied to a two-cylinder rotary compressor, and FIG. 2 is a partial schematic cross sectional view of a rotary compressing element in the two-cylinder rotary compressor in FIG. 1.

In FIG. 1, the reference numeral 201 denotes a metallic closed vessel, and the closed vessel 201 is provided so that an inverter type motor-operating element 202 and a rotary compressing element 203 driven by the motor-operating element 202 are positioned at upper and lower portions within the closed vessel respectively. The motor-operating element 202 is comprised of a substantially annular stator 202*a* fixed to an inner surface of the closed vessel 201 and a rotor 202*b*, which rotates in the stator 202*a*. The rotor 202*a* is journalled to an upper end portion of a rotating shaft 209. The rotary compressing element 203 includes a first rotary compressing element 204 and a second rotary compressing element 205 positioned below the rotary compressing element 204. These first and second rotary compressing elements are partitioned by a partition plate 206. A lower bearing member 207 is attached to a lower portion of the second rotary compressing member 205 and an upper bearing member 208 is attached to an upper portion of the first rotary compressing element 204 so that said rotating shaft 209 is supported.

A terminal 210 is attached to an upper end portion of the closed vessel 201, and a plurality of connection terminals 210*a* penetrating through the terminal 210 are connected to a stator 202*a* of the motor-operating element 202 through internal lead wires not shown and are connected to an external power source through external lead wires. When the stator 202*a* is energized through the terminal 210, the rotor 202*b* is rotated, and the rotation rotates the rotating shaft 209. Further, to an upper end portion of the closed vessel 201 is attached a discharge pipe 211.

A first eccentric portion 209*a* and a second eccentric portion 209*b* are provided on the rotating shaft 209 with a phase shifted by 180°. To the first eccentric portion 209*a* is fitted a first roller 204*a* in said first rotary compressing element 204 and to the second eccentric portion 209*b* is fitted a second roller 205*a* in the second rotary compressing element 205. The first roller 204*a* is eccentrically rotated in a first compressing chamber 204*b* in the first rotary compressing element 204 and the second roller 205*a* is eccentrically rotated in a second compressing chamber 205*b* in the second rotary compressing element 205.

In the first rotary compressing element 204, a first vane 204*c* is biased by a spring 212 to be always in press-contact with the first roller 204*a*, so that the first compressing chamber 204*b* is defined between a low-pressure chamber and a high-pressure chamber although not shown. Further, in the first rotary compressing element 204 is provided a first through hole 204*d*, which communicates with a back pressure portion of the first vane 204*c*. A back pressure is applied to the back pressure portion of the first vane 204*c* by passing of high pressure refrigerant gas in the closed vessel through the first through hole 204*d*.

The second rotary compressing element 205 is not provided with a spring, which biases a second vane 205*c*. When a high-pressure refrigerant gas is supplied to a back pressure portion of the second vane 205*c* through a refrigerant gas switching means 214 to be described later, the second vane 205*c* is pressed to press-contact with the second roller 205*a*. When the second vane 205*c* is brought into press contact with the second roller 205*a*, the second compressing chamber 205*b* is defined between a low-pressure chamber and a high pressure chamber although not shown. As a result the second rotary compressing element 205 becomes in a compressible operating state. When high-pressure refrigerant gas is not supplied to the back pressure portion of the second vane 205*c*, since the second vane 205*c* is not pressed, it is not brought into press contact with the second roller 205*a*. Thus, the second compressing chamber 205*b* is not defined to a low pressure chamber and a high pressure chamber so that the second rotary compressing element 205 becomes in non-compressible and non-operating state. Further, a second through hole 205*d* in the second rotary compressing element 205 is closed by a sealing member 213 to be shut off so that a high-pressure refrigerant gas in the closed vessel 201 does not pass through the second through hole 205*d* so as not to apply a back pressure to the second vane 205*c*.

The sealing member 213 is formed in such a manner that for example a part of the outer circumferential end portion of the partition plate 206 is extended outside, an upper end of the second through hole 205*d* is closed by this extended portion 206*a*, a part of the outer circumferential end portion of the lower bearing member 207 is extended outside, and a lower end of the second through hole 205*d* is closed by this extended portion 207*a* (see FIG. 2). The sealing member 213 is not limited to the above-mentioned example and may be a member, which can close the second through hole 205*d*. In case where the second through hole 205*d* is not previously provided in the second rotary compressing element 205, the sealing member 213 is not needed.

An example of the refrigerant gas switching means 214 is comprised of for example, as shown in FIG. 1, a communicating pipe 215, attached to the outside of the closed vessel 201 in such a manner that one end of the pipe 215 is opened in the closed vessel 201 and the other end of the pipe 215 is opened in a back pressure portion 205*e* of the second vane 205*c* in the second rotary compressing element 205, a branch pipe 216 provided at an intermediate portion of the communicating pipe 215 in a branched manner, and a three-way valve 217 attached to the branch point of the branch pipe 216. Alternatively, the refrigerant gas switching means 214 may be comprised of, although not shown, a communicating pipe, attached to the outside of the closed vessel 201 in such a manner that one end of the pipe is opened in the closed vessel 201 and the other end of the pipe is opened in a back pressure portion 205*e* of the second vane 205*c* in the second rotary compressing element 205, and an open/close valve mounted in a midway portion of the communicating pipe. In this case it is not necessary to provide the branch pipe 216.

Actions of the thus constructed two-cylinder rotary compressor will be described. A low pressure refrigerant gas is supplied to the first rotary compressing element 204 and the second rotary compressing element 205 in the rotary compressing element 203 through introduction pipes not shown respectively. When the stator 202*a* of the inverter type motor-operating element 202 is energized through the terminal 210, the rotor 202*b* is rotated to rotate the rotating shaft 209 and the rotary compressing element 203 is operated to compress a refrigerant gas.

Both high pressure refrigerant gases compressed in the first rotary compressing element 204 and the second rotary compressing element 205 in the rotary compressing element 203 are discharged into the closed vessel 201. The high pressure refrigerant gas discharged into the closed vessel 201 is taken out outside the closed vessel 201 through the discharge pipe 211 and is supplied to a refrigerating cycle in an air conditioner or the like. Then the refrigerant gas circulated in the refrigerating cycle is returned to the compressor from an accumulator (not shown).

Since said motor-operating element 202 is an inverter type, the number of revolutions of the rotating shaft 209 can be controlled by adjusting the frequency. During a high rotation speed, the three-way valve 217 of said refrigerant gas switching means 214 is switched so that a part of the high pressure refrigerant gas in the closed vessel 201 is supplied to the back pressure portion 205*e* of the second vane 205*c* in the second rotary compressing element 205 through the communicating pipe 215. Accordingly, the second vane 205*c* is pressed by the high pressure refrigerant gas supplied to the back pressure portion 205*e* to be brought into press-contact with said second roller 205*a* so that the second compressing chamber 205*b* is defined between a low pressure chamber and a high pressure chamber. Then the second rotary compressing element 205 is maintained in an operation mode. Thus, during high rotation speed both the first rotary compressing element 204 and the second rotary compressing element 205 are operated. It is noted that the first vane 204*c* in the first rotary compressing element 204 is biased by said spring 212 to be brought into press-contact with the first roller 204*a*.

The compression operations of the refrigerant gases in the first rotary compressing element 204 and the second rotary compressing element 205 are substantially the same. Thus, an example for the first rotary compressing element 204 will be explained. The refrigerant gas introduced to said introduction pipe (not shown) is sucked from a suction port (not shown) to the low pressure chamber of said first compressing chamber 204*b* and is compressed by eccentric rotation of the first roller 204*a*. After that the refrigerant gas is discharged from the high-pressure chamber into the closed vessel 201 through a discharge port (not shown).

During a low rotation speed, the three-way valve 217 of said refrigerant gas switching means 214 is switched so that the high refrigerant gas flowed from the closed vessel 201 into the communicating pipe 215 is relieved to the branch pipe 216. Thus, the high-pressure refrigerant gas is not supplied to the back pressure portion 205*e* of the second vane 205*c* in the second rotary compressing element 205 through the communicating pipe 215. Consequently, the second vane 205*c* is not pressed by the high-pressure refrigerant gas so that it is not brought into press-contact with the second roller 205*e*. Further, since the second through hole 205*d* in the second rotary compressing element 205 is closed by the sealing member 213, the high pressure refrigerant gas in the closed vessel 201 is shut off by the sealing member 213 and does not enter the second through hole 205*d*. Thus, the second vane 205*c* is not pressed even by the high-pressure refrigerant gas in the closed vessel 201 and is maintained in a state where the second vane 205*c* is not brought into press-contact with the second roller 205*a*. When the second vane 205*c* is not brought into press-contact with the second roller 205*a*, the second compressing chamber 205*b* cannot be defined between a low pressure chamber and a high pressure chamber whereby the second rotary compressing element 205 is made in a non-operation mode. As a result during low rotation speed, only the first rotary compressing element 204 is operated. In this case, it is preferable to join the high pressure refrigerant gas relieved to the branch pipe 216 during low rotation speed to discharge refrigerant gas by connecting an end portion of the branch pipe 216 to the vicinity of an outlet of the closed vessel 201, or to return the high pressure refrigerant gas into the closed vessel 201 by connecting an end portion of the branch pipe 216 to the closed vessel 201 since a step of relieving the high pressure refrigerant gas to the branch pipe 216 is omitted.

Further, since during a low rotation speed, only the first rotary compressing element 204 is operated and the second rotary compressing element 205 becomes in a non-operating mode, the amount of high-pressure refrigerant gas discharged into the closed vessel 201 is reduced. Then, if the number of revolutions of the rotating shaft 209 for example is increased to about two times, an operation of pump and motor can be made in good efficiency so that COP at small capacity can be improved. In case where the two-cylinder rotary compressor is incorporated into an air conditioner, the variable range of capacity of the air conditioner is increased.

It is noted that the present invention is not limited to the above-mentioned two-cylinder rotary compressor and may be adapted to three or more-cylinder compressor by appropriately modifying said refrigerant gas switching means. Further, the multicylinder rotary compressor according to the present invention can be used by incorporating it not only to an air conditioner but also to a refrigerator, a freezer, a bending machine or the like.

Next, an embodiment of a compressing system according to the present invention will be described in detail with reference to attached drawings.

EXAMPLE 1

Figure 4:
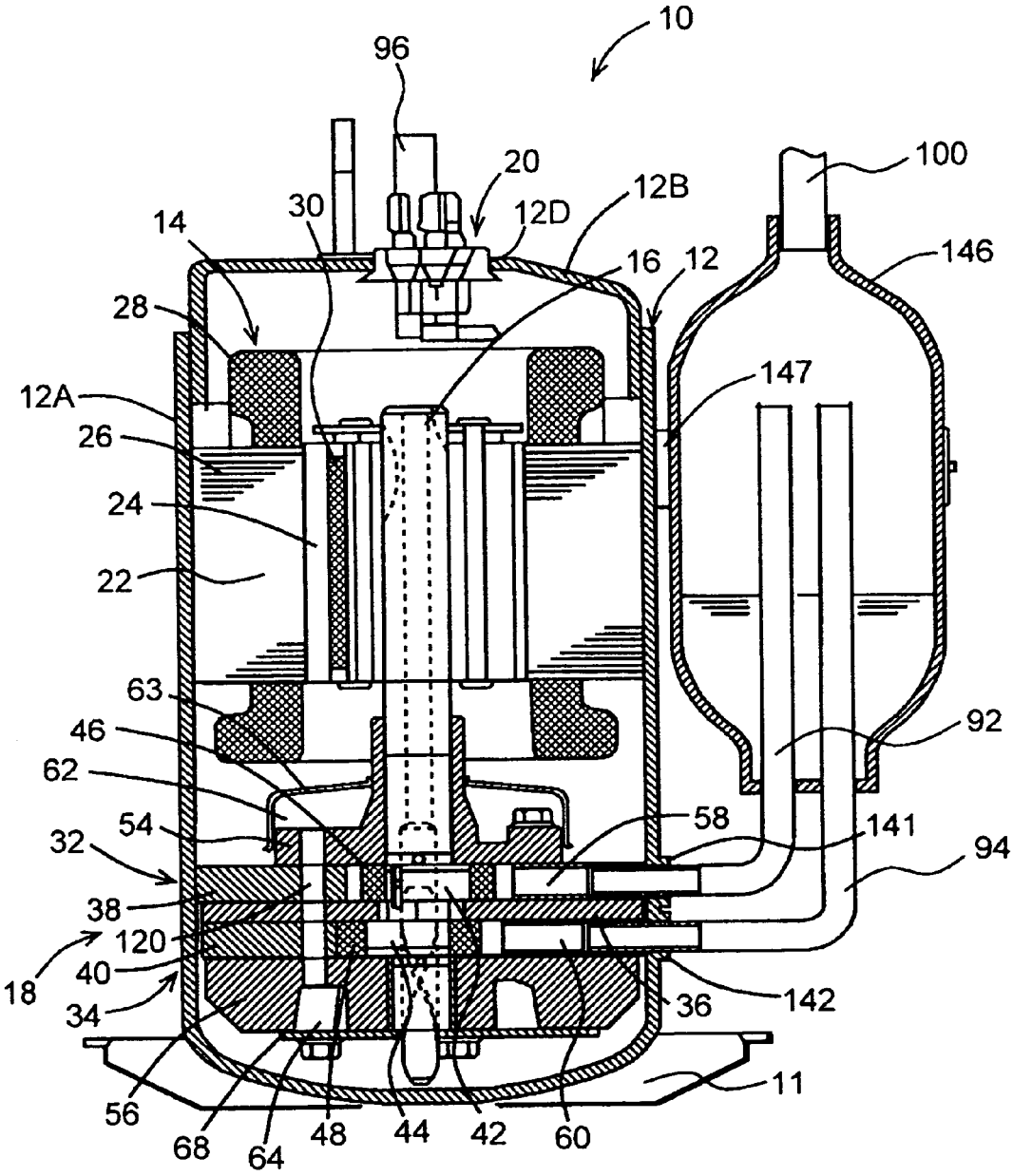
FIG. 4 is a vertical sectional side view showing a first embodiment of a compressing system according to the present invention.
Figure 5:
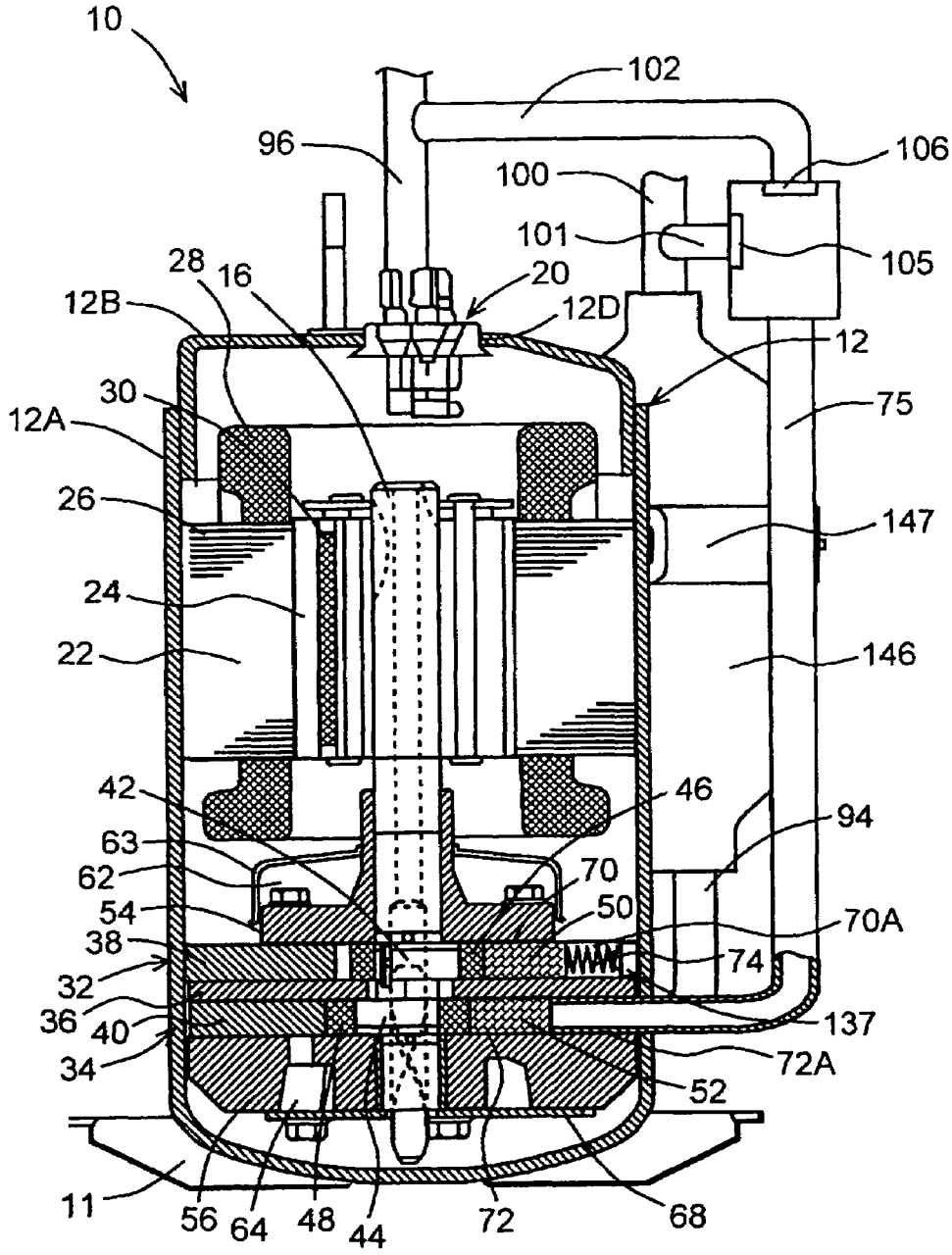
FIG. 5 is a vertical sectional side view of a two-cylinder compressor in FIG. 4.

FIG. 4 is a vertical sectional side view showing a first embodiment of a compressing system CS according to the present invention. FIG. 5 shows a vertical sectional side view (shown by a cross-section different from FIG. 4) of a rotary compressor 10 in FIG. 4. It is noted that the compressing system CS of the present example forms a part of a refrigerant circuit of an air-conditioner as a refrigerating unit, which air-conditions rooms.

Said rotary compressor 10 is an internal high-pressure type rotary compressor provided with first and second rotary compressing elements, and accommodates a motor-operating element 14 as a driving element, disposed on the upper side of the internal space in the closed vessel 12 and a rotary compressing mechanism portion 18 comprised of first and second rotary compressing elements 32 and 34, disposed on the lower side of the motor-operating element 14 and which is driven by the rotating shaft 16 of the motor-operating element 14.

The closed vessel 12 is comprised of a vessel body 12A, whose bottom portion is used as an oil reservoir and which accommodates the motor-operating element 14 and the rotary compressing mechanism portion 18, and a substantially bowl-shaped end cap (lid body) 12B, which closes an upper opening of the vessel body 12A. Also a circular mounting hole 12D is formed on an upper surface of the end cap 12B and to the mounting hole 12D is attached a terminal (wirings omitted) 20, which supplies the motor-operating element 14 with electric power.

Further, to the end cap 12B is attached a refrigerant discharge pipe 96 to be described later, and an end of the refrigerant discharge pipe 96 communicates with the inside of the closed vessel 12. A mounting pedestal 11 is provided on a bottom portion of the closed vessel 12.

The motor-operating element 14 is comprised of a stator 22 welded in an annular shape along the inner circumferential surface of upper space in the closed vessel 12 and a rotor 24 inserted inside the stator 22 with a small gap. This rotor 24 is fixed to a rotating shaft 16 passing through the center and extending in the vertical direction.

Said stator 22 has a laminated body 26 laminated with donut-shaped electromagnetic steel sheets and a stator coil 28 wound around teeth portions of the laminated body 26 by a series winding (concentration winding) method. Further, the rotor 24 is made of a laminated body 30 laminated with electromagnetic steel sheets like the stator 22.

Between the first rotary compressing element 32 and the second rotary compressing element 34 is sandwiched an intermediate partition plate 36. Namely, the first rotary compressing element 32 and the second rotary compressing element 34 are comprised of an intermediate partition plate 36, first and second cylinders 38 and 40, disposed on the upper and lower sides of the intermediate partition plate 36, first and second rollers 46 and 48, fitted respectively onto upper and lower eccentric portions 42 and 44 provided on the rotating shaft 16 in the first and second cylinders 38 and 40 with a phase difference of 180° therebetween, and which respectively eccentrically rotates in the respective cylinders 38 and 40, first and second vanes 50 and 52, which abut on the first and second rollers 46 and 48 respectively and divide the insides of the respective cylinders 38 and 40 into a low pressure chamber side and a high pressure chamber side respectively, an upper supporting member 54 and a lower supporting member 56 as supporting members, which close an upper opening surface of the first cylinder 38 and a lower opening surface of the second cylinder 40 respectively and also serve as bearing for the rotating shaft 16.

The first and second cylinders 38 and 40 are provided with respective suction passages 58 and 60 communicating with the insides of said first and second cylinders 38 and 40 respectively, and to the suction passages 58 and 60 are respectively connected refrigerant introduction pipes 92 and 94 to be described later.

Further, on the upper side of the upper supporting member 54 is provided a discharge muffling chamber 62 and the refrigerant gas compressed by the first rotary compressing element 32 is discharged into said discharge muffling chamber 62. The discharge muffling chamber 62 is formed inside a substantially bowl-shaped cup member 63, which has a hole for the rotating shaft 16 and the upper supporting member 54, which also acts as a bearing of the rotating shaft 16, to let them penetrate at the center and covers the motor-operating element 14 side (uppers side) of the upper supporting member 54. Then the motor-operating element 14 is provided above the cup member 63 with a predetermined space with respect to the cup member 63.

The lower supporting member 56 is provided with a discharge muffling chamber 64 formed by closing a recess portion formed on the lower side of said lower supporting member 56 with a cover as a wall. That is the discharge muffling chamber 64 is closed by a lower cover 68 defining the discharge muffling chamber 64.

In the first cylinder 38 is formed a guide groove 70, which accommodates the above-mentioned first vane 50, and on the outside of the guide groove 70, that is on the back surface side of the first vane 50 is formed an accommodating portion 70A, which accommodates a spring 74 as a spring member. The spring 74 abuts on a back surface side end portion of the first vane 50 and always biases the first vane 50 against the first roller 46 side. Further, to the accommodating portion 70A is introduced for example a discharge side pressure (high pressure) to be described later in the closed vessel 12. The pressure is applied as back pressure of the first vane 50. Then the accommodating portion 70A is opened on the guide groove 70 side and on the closed vessel 12 (vessel body 12A) side, and a metallic plug 137 is provided on the closed vessel 12 side of the spring 74 accommodated in the accommodating portion 70A and acts as a coming-off stopper for the spring 74.

Further, in said second cylinder 40 is formed a guide groove 72, which accommodates the second vane 52, and on the outside of the guide groove 72, that is on the back surface side of the second vane 52 is formed a back pressure chamber 72A. The back pressure chamber 72A is opened on the guide groove 72 side and on the closed vessel 12 side, and with the closed vessel 12 side opening communicates a pipeline 75 to be described later while sealed between the pipeline 75 and the closed vessel 12.

To the side surface of the vessel body 12A of the closed vessel 12 are respectively welded sleeves 141 and 142 at the positions corresponding to the suction passages 58 and 60 of the first cylinder 38 and the second cylinder 40 respectively. These sleeves 141 and 142 abut on each other vertically.

Then to the inside of the sleeve 141 is insertion-connected one end of a refrigerant introduction pipe 92 for introducing a refrigerant gas into the first cylinder 38, and one end of this refrigerant introduction pipe 92 communicates with a suction passage 58 in the upper cylinder 38. The other end of the refrigerant introduction pipe 92 is opened in an accumulator 146.

Further, to the inside of the sleeve 142 is insertion-connected one end of a refrigerant introduction pipe 94 for introducing a refrigerant gas into the second cylinder 40, and one end of this refrigerant introduction pipe 94 communicates with a suction passage 60 in the second cylinder 40. The other end of the refrigerant introduction pipe 94 is opened in an accumulator 146 as in the refrigerant introduction pipe 92.

The accumulator 146 is a tank for separating gas/liquid in a suction refrigerant and is attached to the upper side of the vessel body 12A of the closed vessel 12 through a bracket 147. Then to the accumulator 146 are inserted the refrigerant introduction pipe 92 and the refrigerant introduction pipe 94 through a bottom portion and openings of the other ends are respectively positioned in the accumulator 146. Further, to an upper portion in the accumulator 146 is inserted an end of a refrigerant pipeline 100.

It is noted that the discharge muffling chamber 62 and the discharge muffling chamber 64 communicates with each other through a communicating passage 120, which penetrates through the upper and lower supporting members 54 and 56, the first and second cylinders 38 and 40, and the partition plate 36 in the axial direction (vertically). Then a high temperature, high pressure refrigerant gas compressed by the second rotary compressing element 34 and discharged into the discharge muffling chamber 64 is discharged into the discharge muffling chamber 62 through said communicating passage 120 and is joined with a high temperature, high pressure refrigerant gas compressed by the first rotary compressing element 32.

Further, the discharge muffling chamber 62 and the inside of the closed vessel 12 communicate with each other through a hole not shown, which penetrates through the cup member 63, and the high pressure refrigerant gas compressed by the first rotary compressing element 32 and second rotary compressing element 34 and discharged into the discharge muffling chamber 62 is discharged into the closed vessel 12.

Here, to a midway portion of the refrigerant pipeline 100 is connected a refrigerant pipeline 101, and the pipeline 101 is connected to the above-mentioned pipeline 75 through a solenoid valve 105. Further, to a midway portion of the refrigerant discharge pipe 96 is connected a refrigerant pipeline 102, and the pipeline 102 is connected to the pipeline 75 through a solenoid valve 106 like the refrigerant pipeline 101. The opening/closing of the solenoid valves 105 and 106 is controlled by a controller 130 to be described later, respectively. That is when the valve unit 105 is opened by the controller 130 and the valve unit 106 is closed, the refrigerant pipeline 101 communicates with the pipeline 75. Accordingly, a part of the suction side refrigerants of both rotary compressing elements 32 and 34, which flow in the refrigerant pipeline 100 and flow into the accumulator 146, enters the refrigerant pipeline 101 and flows into a back pressure chamber 72A through the pipeline 75. Consequently, as the back pressure of the second vane 52, suction side pressures of both rotary compressing elements 32 and 34 are applied.

Further, when the valve unit 105 is closed and the valve unit 106 is opened by the controller 130, the refrigerant discharge valve 96 and the pipeline 75 are caused to communicate with each other. Consequently, a part of discharge side refrigerants of both rotary compressing elements 32 and 34, which are discharged from the closed vessel 12 and pass through the refrigerant discharge pipe 96 passes through the refrigerant pipeline 102 and flows into the back pressure chamber 72A through the pipeline 75. As a result the discharge side pressure of both rotary compressing elements 32 and 34 are applied as the back pressure of the second vane 52.

In this case the above-mentioned controller 130 forms a part of the compressing system CS of the present invention, and controls the number of revolutions of the motor-operating element 14 of the rotary compressor 10. Further, the controller 130 also controls the opening/closing of the solenoid-valve 105 in the refrigerant pipeline 101 and of the solenoid-valve 106 in the refrigerant pipeline 102.

Figure 6:
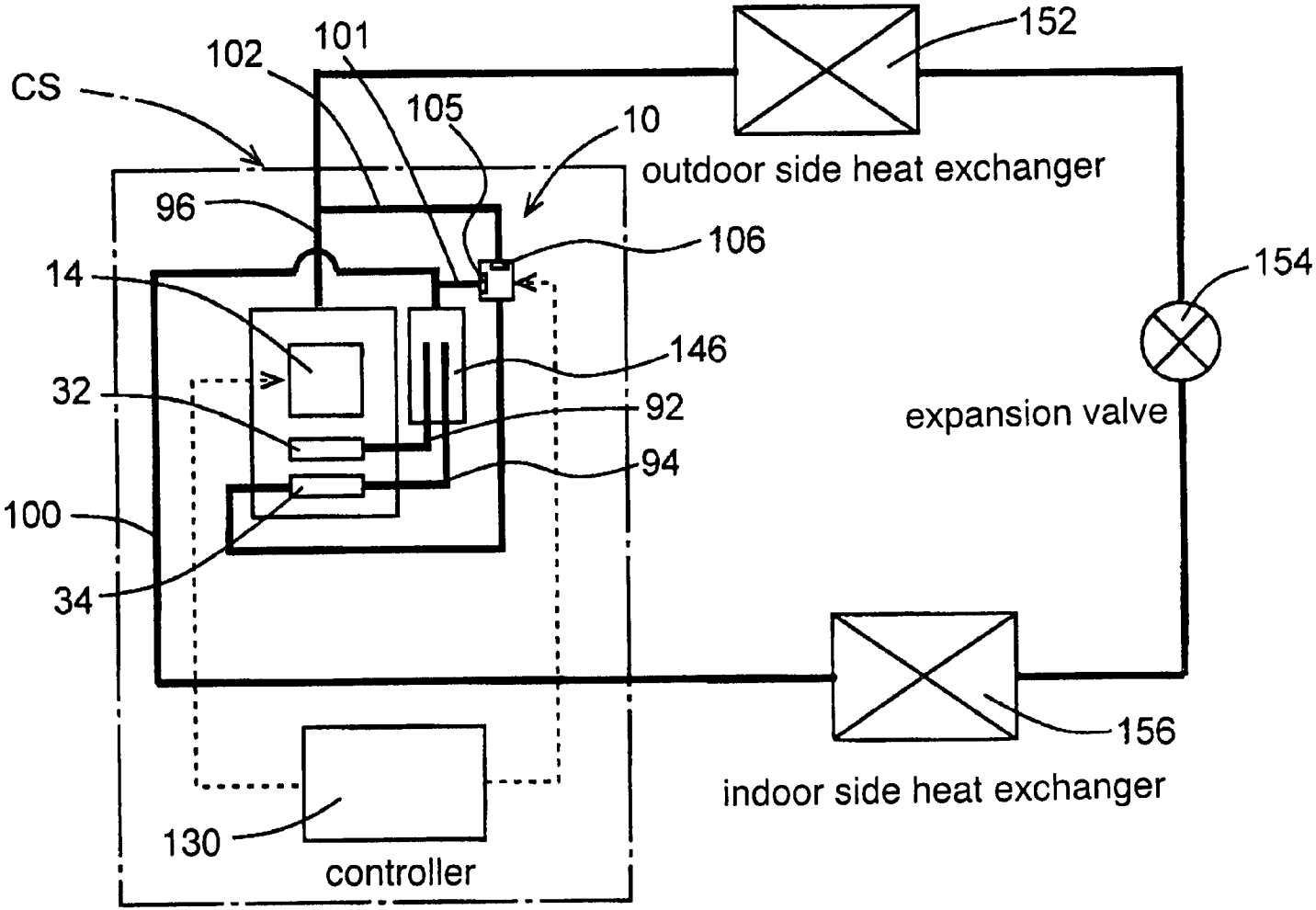
FIG. 6 is refrigerant circuit view of an air-conditioner using the compressing system according to the present invention.

FIG. 6 shows a refrigerant circuit diagram in the air-conditioner formed by use of the compression system CS. That is the compressing system CS of the present example forms a part of refrigerant circuit of the air-conditioner shown in FIG. 6 and is comprised of the above-mentioned rotary compressor 10, the controller 130 and the like. A refrigerant discharge pipe 96 in the rotary compressor 10 is connected to an inlet of an outdoor side heat exchanger 152. The controller 130, the rotary compressor 10 and the outdoor side heat exchanger 152 are provided in an outdoor side machine (not shown) for the air-conditioner. A pipeline connected to the outlet of this outdoor side heat exchanger 152 is connected to an expansion valve 154 as a pressure-reducing means and the pipeline extending from the expansion valve 154 is connected to the indoor side heat exchanger 156. These expansion valve 154 and the indoor side heat exchanger 156 are provided in an indoor side machine (not shown) for the air-conditioner. Further, to the outlet side of the indoor side heat exchanger 156 is connected said refrigerant pipeline 100 in the rotary compressor 10.

It is noted that as a refrigerant, an HFC base or an HC base refrigerant is used, and oil as lubricating oil, existing oil such as a mineral oil, an alkyl benzene oil, an ether oil, an ester oil or the like, is used.

Figure 7:
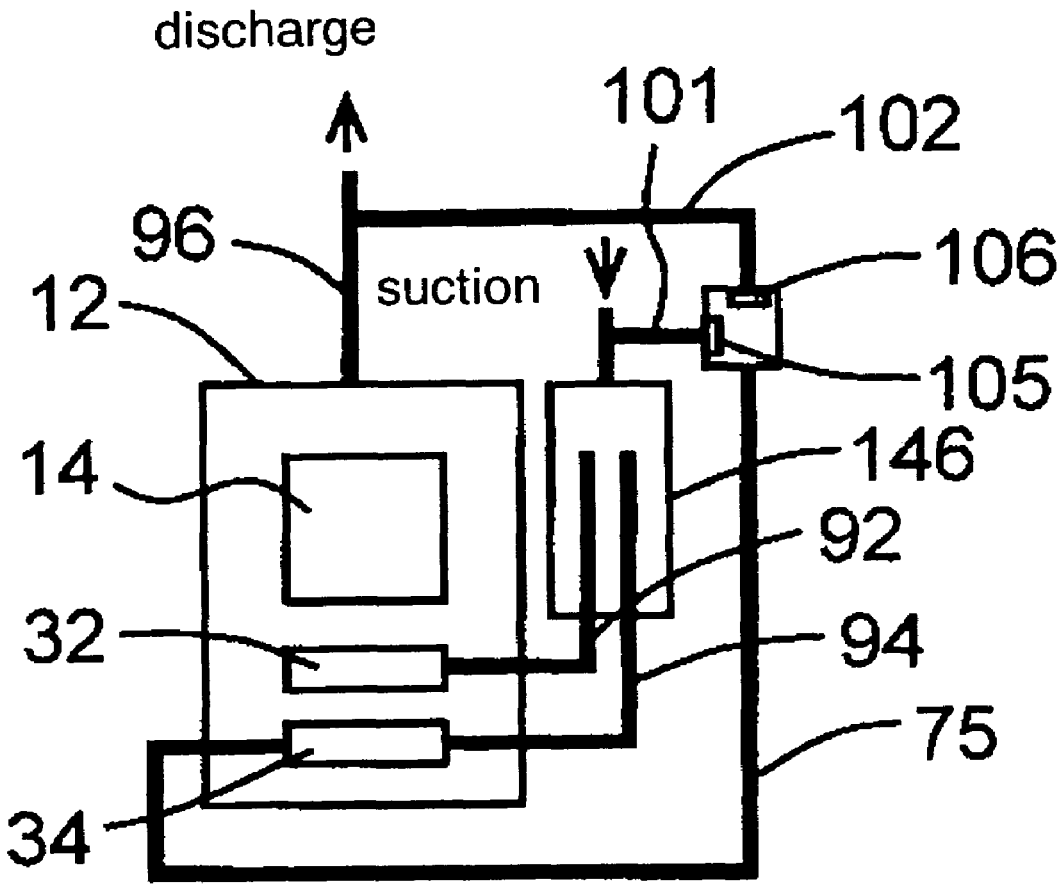
FIG. 7 is an explanatory view showing the refrigerant flow in a first operation mode in the compressing system in FIG. 4.

In the above-mentioned configuration, actions of the rotary compressor 10 will be described. The controller 130 controls the number of revolutions of the motor-operating element 14 of the rotary compressor 10 in accordance with an operation command input from the controller (not shown) on the indoor side machine side provided in the above mentioned indoor machine, and at the same time in case where the indoor side is under generally loaded conditions or highly loaded conditions, the controller 130 executes a first operation mode. The controller 130 closes the solenoid-valve 105 of the refrigerant pipeline 101 and the solenoid-valve 106 of the refrigerant pipeline 102 in this first operation mode (see FIG. 7).

Then when the stator coil 28 of the motor-operating element 14 is energized through the terminal 20 and wiring not shown, the motor-operating element 14 is started and the rotor is rotated. By this rotation the first and second rollers 46 and 48 are respectively fitted onto the upper and lower eccentric portions 42 and 44 integrally provided with the rotating shaft 16 to be rotated eccentrically in the first and second cylinders 38 and 40, respectively.

Accordingly, a low-pressure refrigerant flows into the accumulator 146 through the refrigerant pipeline 100 of the rotary compressor 10. Since the solenoid valve 105 of the refrigerant pipeline 101 is in a closed mode as mentioned above, all refrigerants, passing through the refrigerant pipeline 100 flow into the accumulator 146 without flowing into the pipeline 75.

After the low-pressure refrigerant which flowed into the accumulator 146 is gas/liquid separated there, only refrigerant gas enters the respective refrigerant introduction pipes 92 and 94 opened in said accumulator 146. A low-pressure refrigerant gas entered the refrigerant introduction pipe 92 passes through the suction passage 58 and is sucked into the low-pressure chamber side of the first cylinder 38 in the first rotary compressing element 32.

The refrigerant gas sucked into the low-pressure chamber side of the first cylinder 38 is compressed by operations of the first roller 46 and first vane 50 and becomes a high temperature, high pressure refrigerant gas. Then the refrigerant gas passes through a discharge port (not shown) from the high pressure chamber side of the first cylinder 38 and is discharged into the discharge muffling chamber 62.

On the other hand, the low-pressure refrigerant gas entered the refrigerant introduction pipe 94 passes through the suction passage 60 and is sucked into the low-pressure chamber side of the second cylinder 40 in the second rotary compressing element 34. The refrigerant gas sucked into the low-pressure chamber side of the second cylinder 40 is compressed by operations of the second roller 48 and second vane 52.

At this time, since the solenoid-valve 105 and the solenoid-valve 106 are closed as mentioned above, the inside of the pipeline 75 connected to the back pressure chamber 72A of the second vane 52 is a closed space. Further, into the back pressure chamber 72A flows not a little amount of refrigerant in the second cylinder 40 from between the second vane 52 and the accommodating portion 70A. Accordingly, the pressure in the back pressure chamber 72A in the second vane 52 reaches an intermediate pressure between the suction side pressure and the discharge side pressure of both rotary compressing elements 32 and 34, and conditions where this intermediate pressure is applied as a back pressure for the second vane 52 are formed. This intermediate pressure allows the second vane 52 to be sufficiently biased against the second roller 48 without use of a spring member.

Figure 12:
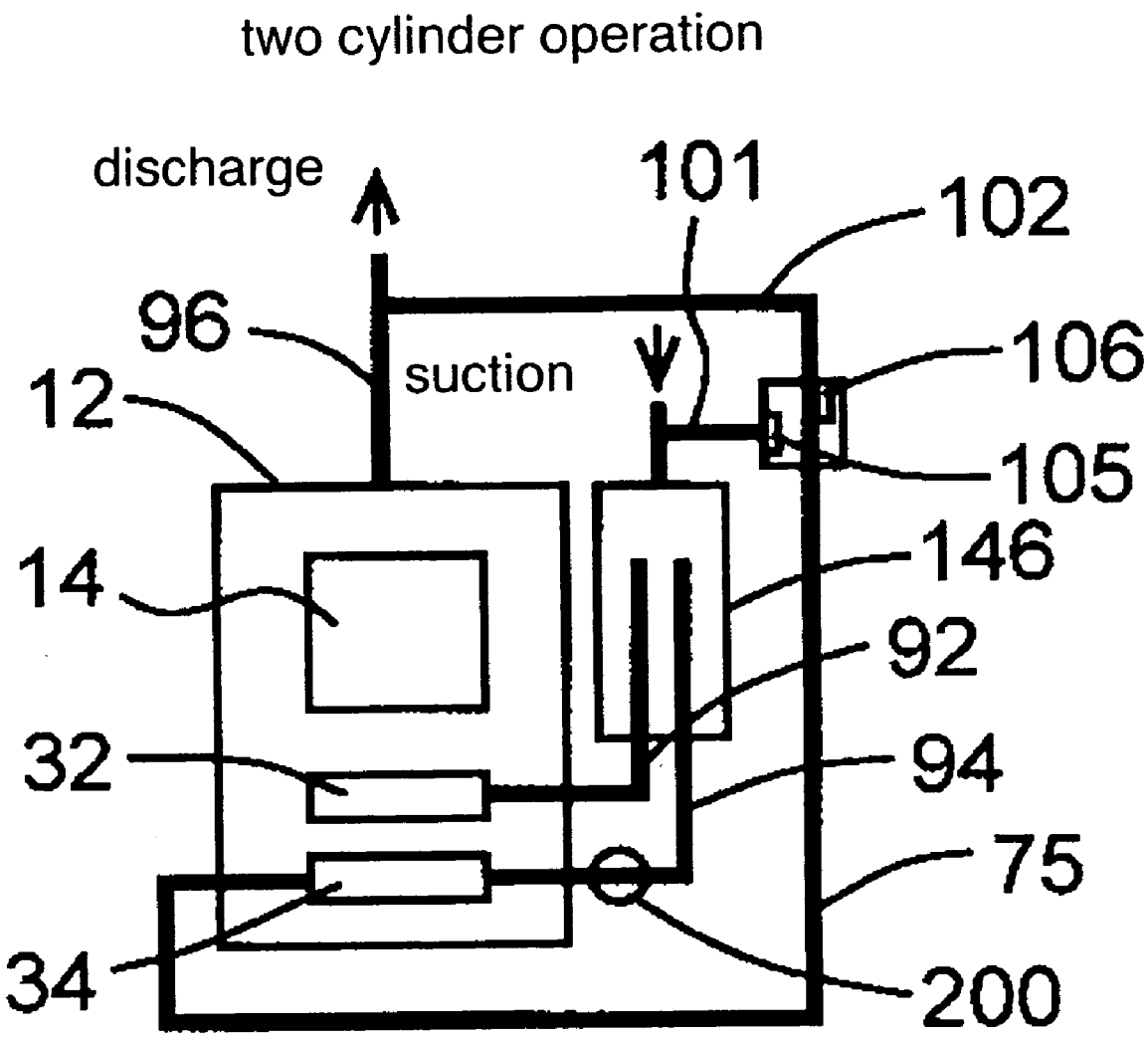
FIG. 12 is an explanatory view showing the refrigerant flow during two-cylinder operation in a conventional two-cylinder rotary compressor.

Further, in a conventional case as shown in FIG. 12, high pressure, which is discharge side pressure of both rotary compressing elements 32 and 34 was applied as a back pressure for the second vane 52. However, in this case since the discharge side pressure has a large pulsation and no spring member is provided, this pulsation deteriorates the follow-up of the second vane 52 and compression efficiency is lowered. Additionally, a problem of occurrence of collision noise between the second vane 52 and the second roller 48 was caused.

However, since in the present invention an intermediate pressure between the suction side pressure and the discharge side pressure of both rotary compressing elements 32 and 34 is applied as a back pressure of the second vane 52, the pressure pulsation becomes remarkably small as compared with the case where the discharge side pressure is applied as mentioned above. Particularly, in the present example, the solenoid valves 105 and 106 are closed so that conditions where the inflow of the suction side refrigerant and discharge side refrigerant of both rotary compressing elements 32 and 34 through the pipeline 75 is shut off, are formed. Thus in the present invention the back pressure pulsation for the second vane 52 can be further suppressed. As a result the follow-up of the second vane 52 in the first operation mode is improved and the compression efficiency of the second rotary compressing element 34 is also improved.

It is noted that the refrigerant gas, which was compressed by the operations of the second roller 48 and second vane 52 and became in high temperature and high pressure, passes through the inside of the a discharge port (not shown) from the high pressure chamber side of the second cylinder 40 and is discharged into the discharge muffling chamber 64. The refrigerant gas discharged into the discharge muffling chamber 64 passes through the communicating passage 120 and is discharged into the discharge muffling chamber 62, and then joined with the refrigerant gas compressed by the first rotary compressing element 32. Then the joined refrigerant gas is discharged into the closed vessel 12 through a hole (not shown) penetrating through the cup member 63.

After that the refrigerant in the closed vessel 12 is discharged from the refrigerant discharge pipe 96 formed in the end cap 12B of the closed vessel 12 to the outside and flows into the outdoor side heat exchanger 152. The refrigerant gas is heat-dissipated there and pressure-reduced by the expansion valve 154. After that the refrigerant gas flows into the indoor side heat exchanger 156. The refrigerant is evaporated in the indoor side heat exchanger 156 and absorbs heat from air circulated in the room so that it exhibits cooling action to cool the room. Then the refrigerant repeats a cycle of leaving the indoor side heat exchanger 156 and being sucked into the rotary compressor 10.

EXAMPLE 2

Figure 8:
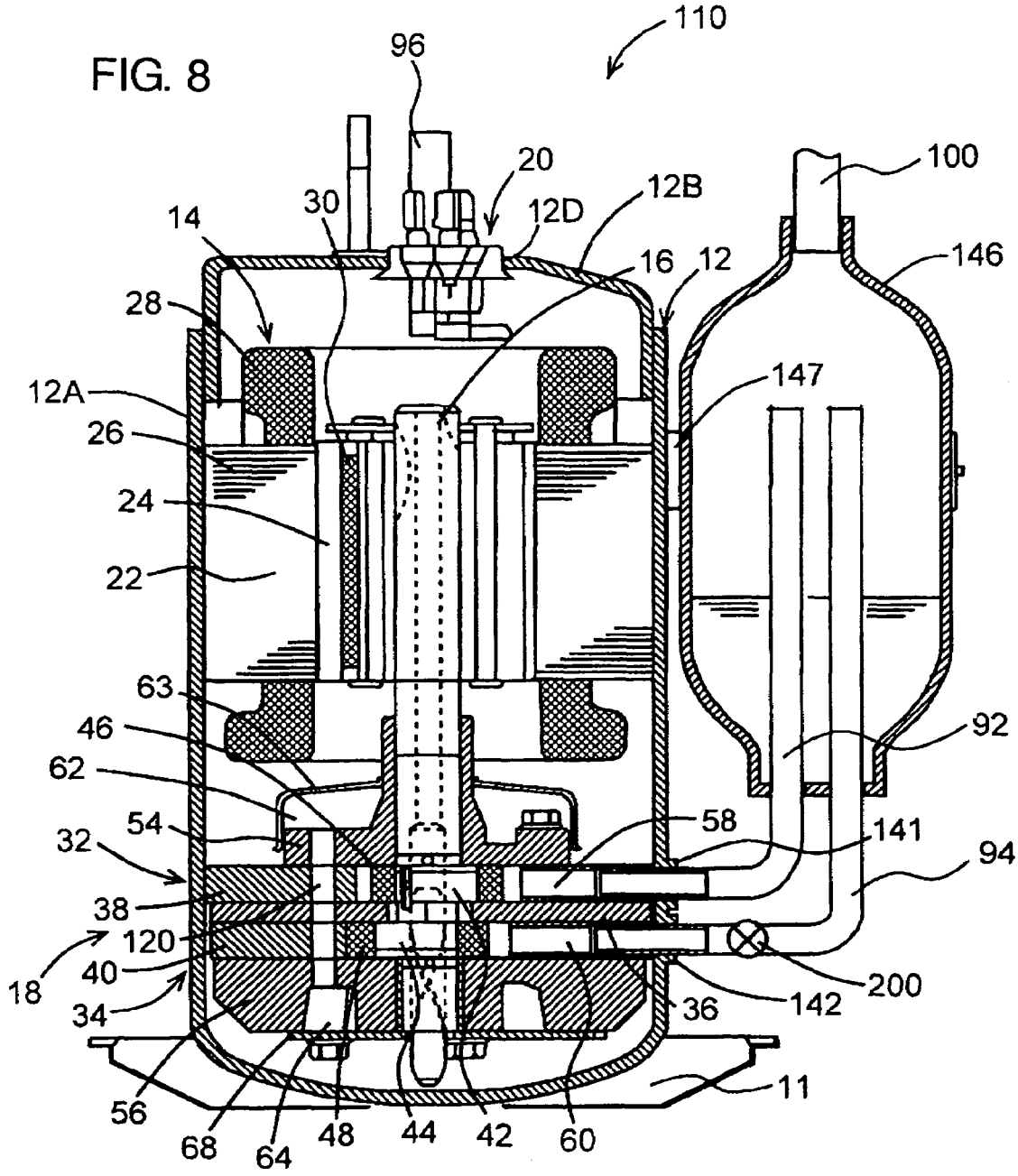
FIG. 8 is a vertical sectional side view showing a second embodiment of a compressing system according to the present invention.

Next, a second embodiment of a compressing system CS according to the present invention will be described. FIG. 8 shows a vertical sectional side view of an inside high pressure type rotary compressor 110 provided with first and second rotary compressing elements as a multicylinder rotary compressor of a compressing system CS in this case. It is noted that in FIG. 8, reference numerals denoted by the same numerals as in FIGS. 4 to 7 exhibit the same effects.

In FIG. 8, the reference numeral 200 denotes a valve unit and is provided on the outlet side of an accumulator 146 and in the midway portion of a refrigerant introduction pipe 94 on the inlet side of a closed vessel 12. The solenoid-valve (valve unit) 200 is a valve unit for controlling inflow of a refrigerant into a second cylinder 40 and is controlled by the above-mentioned controller 130 as a control device.

It is noted that in the present example, as a refrigerant, an HFC base or HC base refrigerant is used as in the above-mentioned example, and oil as lubricating oil, existing oil such as mineral oil, alkyl benzene oil, ether oil, or ester oil is used.

In the above construction, actions of the rotary compressor 10 will be described.

(1) First Operation Mode (Operation Under Generally Loaded Conditions or Highly Loaded Conditions)

Figure 9:
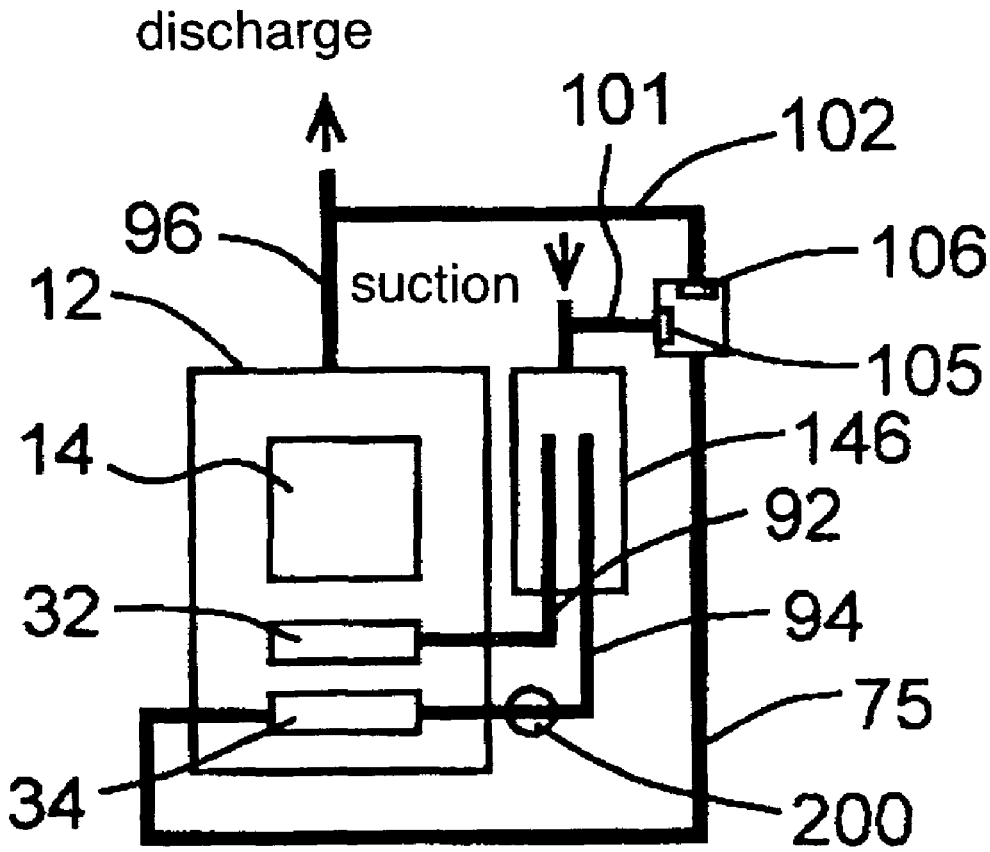
FIG. 9 is an explanatory view showing the refrigerant flow in a first operation mode in the two-cylinder rotary compressor in FIG. 8.

First, a first operation mode in which both compressing elements 32 and 34 performs compression work will be described with reference to FIG. 9. The controller 130 controls the number of revolutions of the motor-operating element 14 of the rotary compressor 110 in accordance with an operation command input from the controller (not shown) of the indoor side machine provided in the above-mentioned indoor machine, and at the same time in case where the indoor side is under generally loaded conditions or highly loaded conditions, the controller 130 executes a first operation mode. The controller 130 opens the solenoid-valve 200 of the refrigerant introduction pipe 94 and closes the solenoid-valve 105 of the refrigerant pipeline 101 and the solenoid-valve 106 of the refrigerant pipeline 102 in this first operation mode.

Then when the stator coil 28 of the motor-operating element 14 is energized through the terminal 20 and wiring not shown, the motor-operating element 14 is started and the rotor 24 is rotated. By this rotation the first and second rollers 46 and 48 are respectively fitted onto the upper and lower eccentric portions 42 and 44 integrally provided with the rotating shaft 16 to be rotated eccentrically in the first and second cylinders 38 and 40, respectively.

Accordingly, a low-pressure refrigerant flows into the accumulator 146 through the refrigerant pipeline 100 of the rotary compressor 110. Since the solenoid valve 105 of the refrigerant pipeline 101 is in a closed mode as mentioned above, all refrigerants, passing through the refrigerant pipeline 100 flow into the accumulator 146 without flowing into the pipeline 75.

After the low-pressure refrigerant which flowed into the accumulator 146 is gas/liquid separated there, only refrigerant gas enters the respective refrigerant introduction pipes 92 and 94 opened in said accumulator 146. A low-pressure refrigerant gas entered the introduction pipes 92 passes through the suction passage 58 and is sucked into a low-pressure chamber side of the first cylinder 38 in the first rotary compressing element 32.

The refrigerant gas sucked into the low-pressure chamber side of the first cylinder 38 is compressed by operations of the first roller 46 and first vane 50 and becomes a high temperature, high pressure refrigerant gas. Then the refrigerant gas passes through a discharge port (not shown) from the high-pressure chamber side of the first cylinder 38 and is discharged into the discharge muffling chamber 62.

On the other hand, the low-pressure refrigerant gas entered the refrigerant introduction pipe 94 passes through the suction passage 60 and is sucked into the low-pressure chamber side of the second cylinder 40 in the second rotary compressing element 34. The refrigerant gas sucked into the low-pressure chamber side of the second cylinder 40 is compressed by operations of the second roller 48 and second vane 52.

At this time, since the solenoid-valve 105 and the solenoid-valve 106 are closed as mentioned above, the inside of the pipeline 75 connected to the back pressure chamber 72A of the second vane 52 is a closed space. Further, into the back pressure chamber 72A flows not a little amount of refrigerant in the second cylinder 40 from between the second vane 52 and the accommodating portion 70A. Accordingly, the pressure in the back pressure chamber 72A in the second vane 52 reaches an intermediate pressure between the suction side pressure and the discharge side pressure of both rotary compressing elements 32 and 34, and conditions where this intermediate pressure is applied as a back pressure for the second vane 52 are formed. This intermediate pressure allows the second vane 52 to be sufficiently biased against the second roller 48 without use of a spring member.

As a result the follow-up of the second vane 52 in the first operation mode is improved and the compression efficiency of the second rotary compressing element 34 can be also improved as in the above-mentioned Example 1.

It is noted that the refrigerant gas, which was compressed by the operations of the second roller 48 and second vane 52 and became in high temperature and high pressure, passes through the inside of the a discharge port (not shown) from the high pressure chamber side of the second cylinder 40 and is discharged into the discharge muffling chamber 64. The refrigerant gas discharged into the discharge muffling chamber 64 passes through the communicating passage 120 and is discharged into the discharge muffling chamber 62, and then joined with the refrigerant gas compressed by the first rotary compressing element 32. Then the joined refrigerant gas is discharged into the closed vessel 12 through a hole (not shown) penetrating through the cup member 63.

After that the refrigerant in the closed vessel 12 is discharged from the refrigerant discharge pipe 96 formed in the end cap 12B of the closed vessel 12 to the outside and flows into the outdoor side heat exchanger 152. The refrigerant gas is heat-dissipated there and pressure-reduced by the expansion valve 154. After that the refrigerant gas flows into the indoor side heat exchanger 156. The refrigerant is evaporated in the indoor side heat exchanger 156 and absorbs heat from air circulated in the room so that it exhibits cooling action to cool the room. Then the refrigerant repeats a cycle of leaving the indoor side heat exchanger 156 and being sucked into the rotary compressor 110.

(2) Second Operation Mode (Operation Under Lightly Loaded Conditions)

Figure 10:
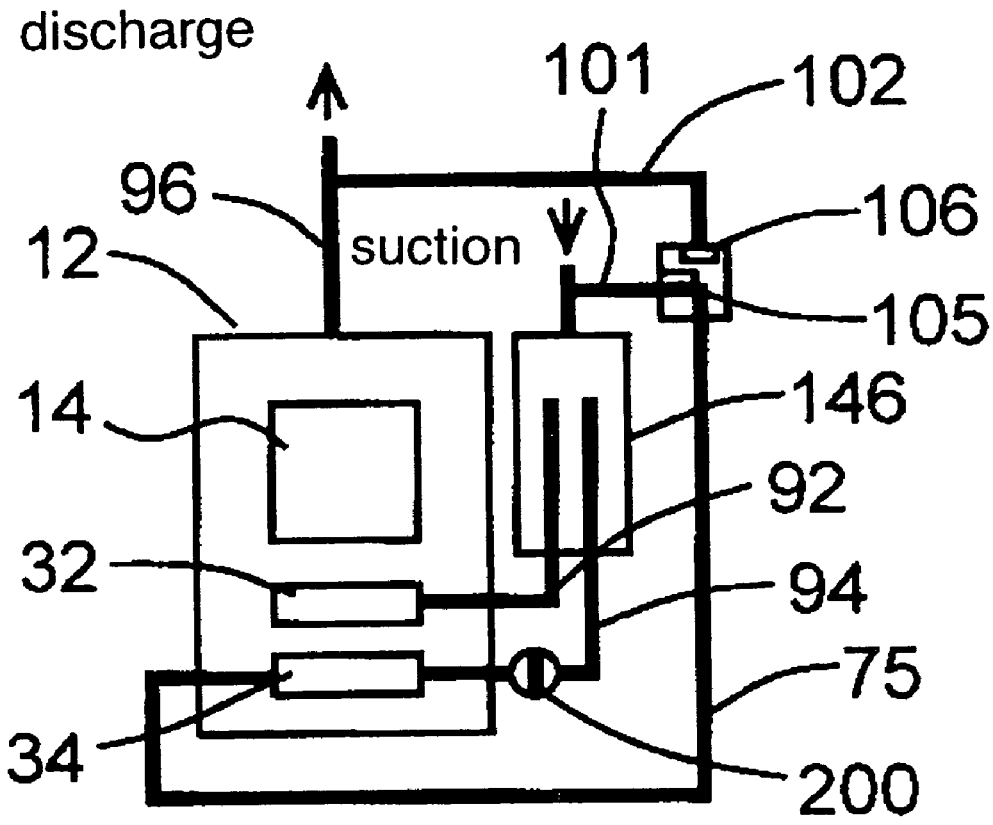
FIG. 10 is an explanatory view showing the refrigerant flow in a second operation mode in the two-cylinder rotary compressor in FIG. 8.

Next, a second operation mode will be described by use of FIG. 10. When the indoor inside is under lightly loaded conditions, the controller 130 transfers the first operation mode to the second mode. The second mode is a mode where substantially only the first rotary compressing element 32 execute compression-work and is an operation mode, which is performed in case where the indoor inside becomes under lightly loaded conditions and the motor-operating element 14 becomes low speed rotation in the first operation mode. In a small capacity area in the compressing system CS, by allowing substantially only the first rotary compressing element 32 to execute compression work the amount of compressing refrigerant gas can be more reduced than in case where compression work is executed by both first and second cylinders 38 and 40. Thus the number of revolutions of the motor-operating element 14 can be increased even under lightly loaded conditions by the part of the reduced amount of refrigerant gas, the operation efficiency of the motor-operating element 14 can be improved and the leakage loss of refrigerant gas can be reduced.

In this case, the controller 130 closes the above-mentioned solenoid-valve 200 to block the inflow of refrigerant gas to the second cylinder 40. Consequently, compression work is not executed in the second rotary compressing element 34. Further, when the inflow of refrigerant gas to the second cylinder 40 is blocked, the inside of the second cylinder 40 reaches a little higher pressure than suction side pressure of the above-mentioned both rotary compressing elements 32 and 34 (this is because the second roller 48 is rotated and the high pressure inside the closed vessel 12 slightly flows into the second cylinder 40 through a gap or the like of the second cylinder 40, resulting in that the inside of the second cylinder 40 reaches a little higher pressure than the suction side pressure).

Further, the controller 130 opens the solenoid-valve 105 of the refrigerant pipeline 101 and closes the solenoid-valve 106 of the refrigerant pipeline 102. Thus the refrigerant pipeline 101 communicates with the pipeline 75 so that the suction side refrigerant in the first rotary compressing element 32 flows into the back pressure chamber 72A, resulting in that as back pressure of the second vane 52 the suction side pressure in the first rotary compressing element 32 is applied.

On the other hand, the controller 130 energizes the stator coil 28 of the motor-operating element 14 through the above-mentioned terminal 20 and wiring not shown to rotate the rotor 24 of the motor-operating element 14. By this rotation the first and second rollers 46 and 48 are respectively fitted onto the upper and lower eccentric portions 42 and 44 integrally provided with the rotating shaft 16 to be rotated eccentrically in the first and second cylinders 38 and 40, respectively.

Accordingly, a low-pressure refrigerant flows into the accumulator 146 through the refrigerant pipeline 100 of the rotary compressor 110. In this case, since the solenoid valve 105 of the refrigerant pipeline 101 is in an open mode as mentioned above, a part of the suction side refrigerant in the first rotary compressing element 32, which passes through the refrigerant pipeline 100 flows into the back pressure chamber 72A from the refrigerant pipeline 101 through the pipe line 75. Accordingly, the back pressure chamber 72A reaches a suction side pressure in the first rotary compressing element 32 and as a back pressure for the second vane 52 the suction side pressure in the first rotary compressing element 32 is applied.

Figure 13:
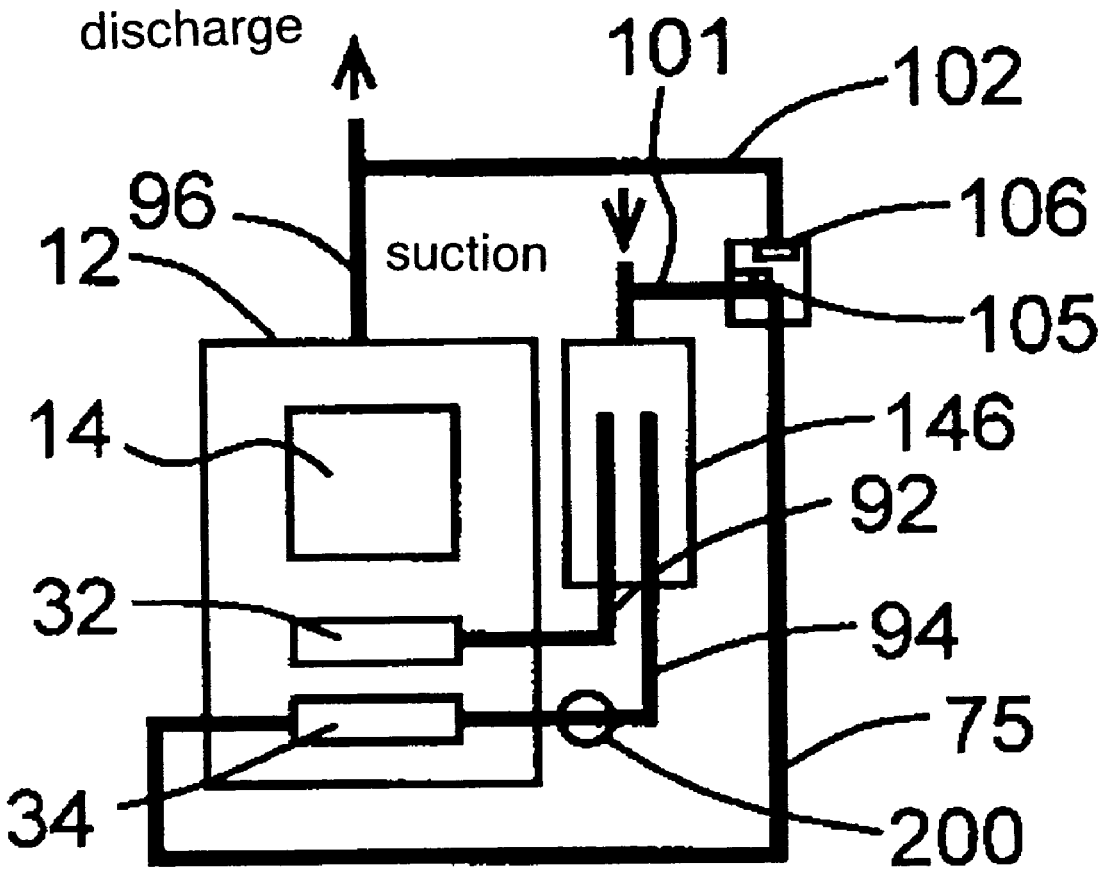
FIG. 13 is an explanatory view showing the refrigerant flow during one-cylinder operation in a conventional two-cylinder rotary compressor.

Since, in a conventional case, when a refrigerant is caused to flow into the second cylinder 40 as shown in FIG. 13, the inside of the second cylinder 40 and the back pressure 72A reach the same suction side pressure in the first rotary compressing element 32, the second vane 52 is protruded in the second cylinder 40 and may collide with the second roller 48.

However, if the solenoid valve 200 is closed to block the inflow of refrigerant into the second cylinder 40 so that the inside of the second cylinder 40 is set at pressure higher than the suction side pressure in the first rotary compressing element 32 as in the present invention, the pressure in the second cylinder 40 becomes higher than the back pressure for the second vane 52 by applying suction side pressure in the first rotary compressing element 32 as a back pressure for the second vane 52. Thus, the second vane 52 is pressed to the back pressure chamber 72A side, which is the opposite side to the second roller 48, by pressure in the second cylinder 40, so that the second vane 52 is not protruded in the second cylinder 40. As a result disadvantages that the second vane 52 is protruded in the second cylinder 40 and collides with the second roller 48 to produce collision noise can be previously avoided.

On the other hand, after the low-pressure refrigerant which flowed into the accumulator 146 is gas/liquid separated there, only refrigerant gas enters the respective refrigerant introduction pipe 92 opened in the accumulator 146. A low-pressure refrigerant gas entered the introduction pipe 92 passes through the suction passage 58 and is sucked into the low-pressure chamber side of the first cylinder 38 in the first rotary compressing element 32.

The refrigerant gas sucked into the low-pressure chamber side of the first cylinder 38 is compressed by operations of the first roller 46 and first vane 50 and becomes a high temperature, high pressure refrigerant gas. Then the refrigerant gas passes through a discharge port (not shown) from the high-pressure chamber side of the first cylinder 38 and is discharged into the discharge muffling chamber 62. Then, since in the second operation mode, the discharge muffling chamber 62 functions as an expansion type muffling chamber and the discharge muffling chamber 64 functions as a resonance type muffling chamber, the pressure pulsation of the refrigerant compressed by the first rotary compressing element 32 can be further reduced. Accordingly, in the second operation mode where compression work is executed by substantially only the first rotary compressing element 32, the muffling effect can be further improved.

The refrigerant gas discharged into the discharge muffling chamber 62 is discharged into the closed vessel 12 through a hole (not shown) penetrating through the cup member 63. After that the refrigerant in the closed vessel 12 is discharged from the refrigerant discharge pipe 96 formed in the end cap 12B of the closed vessel 12 to the outside and flows into the outdoor side heat exchanger 152. The refrigerant gas is heat-dissipated there and pressure-reduced by the expansion valve 154. After that the refrigerant gas flows into the indoor side heat exchanger 156. The refrigerant is evaporated in said indoor side heat exchanger 156 and absorbs heat from air circulated in the room so that it exhibits cooling action to cool the room. Then the refrigerant repeats a cycle of leaving the indoor side heat exchanger 156 and being sucked into the rotary compressor 110.

As described above, according to the present invention, improvements in performance and reliability of a compressing system CS provided with a rotary compressor 110 usable by switching between a first operation mode where the first and second rotary compressing elements 32 and 34 execute compression work and the second operation mode where substantially only the first rotary compressing element 32 executes compression work, can be effected.

Thus, by forming refrigerant circuits in an air conditioner by use of such compressing system CS the operation efficiency and performance of said air conditioner is improved so that the reduction in power consumption can also be effected.

EXAMPLE 3

In the above-mentioned respective examples, as a refrigerant an HFC base or HC base refrigerant was used. However, a refrigerant obtained by combination of refrigerants having large pressure difference between high and low pressures such as carbon dioxide, for example carbon dioxide and PAG (polyalkyl glycol) as a refrigerant, may be used. In this case, since refrigerants compressed by the respective rotary compressing elements 32 and 34 reach very high pressure, when the discharge muffling chamber 62 has such shape that an upper side of the upper supporting member 54 is covered with the cup member 63 as in the respective examples, the cup member 63 may be broken by such high pressure.

Figure 11:
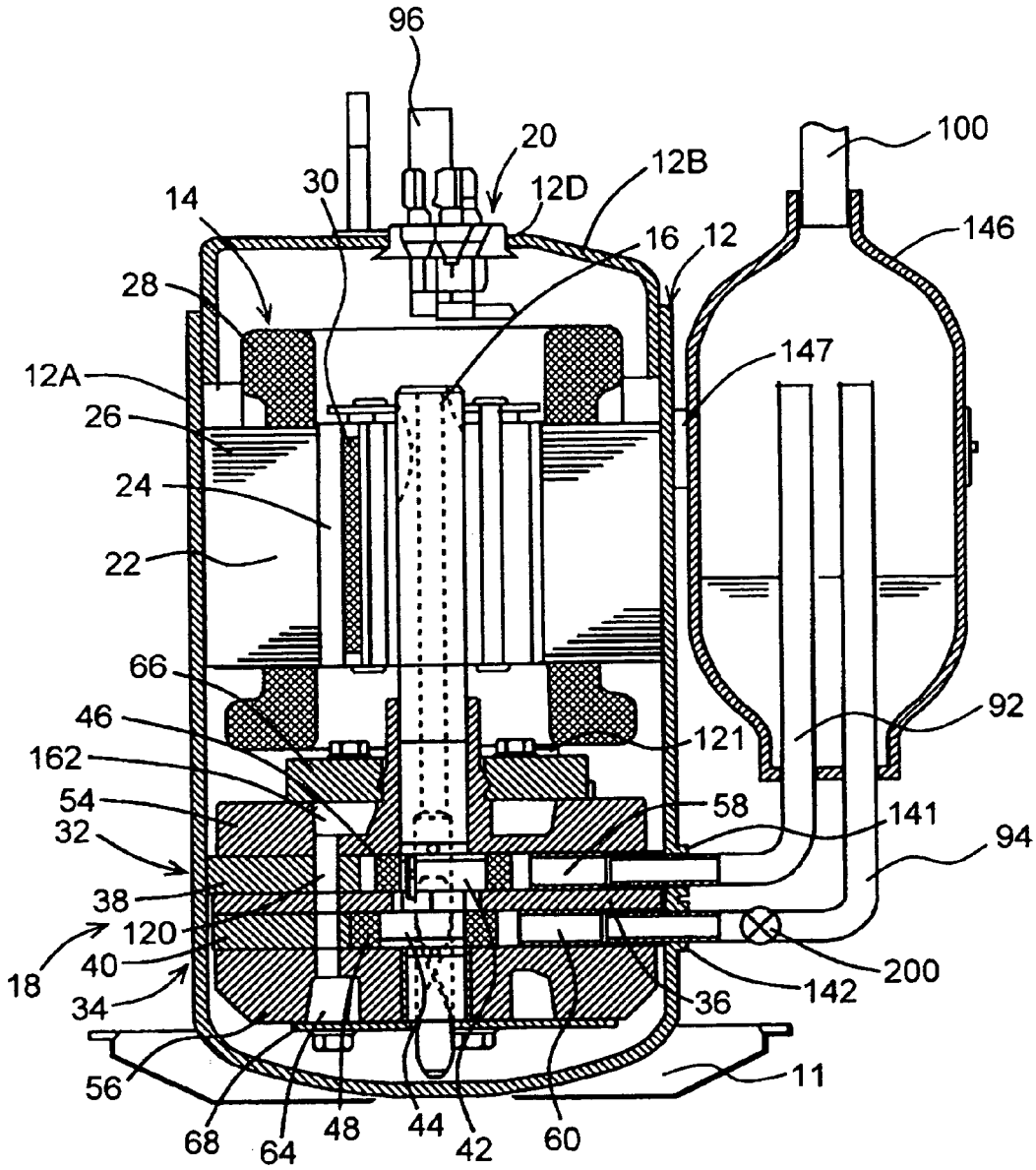
FIG. 11 is a vertical sectional side view showing a third embodiment of a compressing system according to the present invention.

Therefore, if a shape of an upper side discharge muffling chamber of the upper supporting member 54 where the refrigerants compressed by both rotary compressing elements 32 and 34 are joined with each other is designed as a shape as shown in FIG. 11, the pressure tightness can be ensured. Namely, a discharge muffling chamber 162 is formed by forming a recess portion on the upper side of the upper supporting member 54 and closing the recess portion with an upper cover 66 as a cover. Consequently, even if a refrigerant contains a refrigerant having large pressure difference between high and low pressures such as carbon dioxide, the present invention can be applied.

It is noted that although the respective examples were explained by use of a rotary compressor having a vertically placed rotating shaft 16, this invention can be of course applied to even a case where a rotary compressor having a horizontally placed rotating shaft is used.

Further, although the above-mentioned examples use two cylinder rotating compressor, the present invention may be applied to a compressing system provided with a multicylinder rotary compressor provided with a three-cylinder or more rotary compressing element.

The multicylinder rotary compressor according to the present invention and a compressing system and a refrigerating unit each provided with the multicylinder rotary compressor can be preferably utilized for various air conditioners as well as a refrigerator, a freezer, a freezer/refrigerator, and the like.

What is claimed is:

1. A multicylinder rotary compressor comprising:

a closed vessel;

a refrigerant discharge pipe having a first end inside of the closed vessel;

first and second rotary compressing elements provided in said closed vessel;

said first rotary compressing element including a first cylinder with a first roller configured to rotate in said first cylinder and a first vane accommodated by a first guide groove formed in said first cylinder to compress a refrigerant gas, said first vane being biased against said first roller by a first spring member;

said second rotary compressing element including a second cylinder with a second roller configured to rotate in said second cylinder and a second vane accommodated by a second guide groove formed in said second cylinder to compress a refrigerant gas;

wherein the second rotary compressing element is not provided with a spring member that biases the second vane against said second roller;

wherein each of the first and second rotary compressing elements has a suction side input and a pressure side output;

a back pressure pipeline having a first end communicating with a back pressure chamber formed on a back surface side of the second vane;

a motor coupled to said first and second rotary compressing elements, said motor configured to rotate said first and second rotary compressing elements;

an accumulator tank a first refrigerant pipeline having a first end inserted into an upper portion of the accumulator tank;

a first refrigerant introduction pipe having a first end communicating with the suction side input of the first rotary compressing element and a second end opened in the accumulator tank;

a second refrigerant introduction pipe having a first end communicating with the suction side input of the second rotary compressing element and a second end opened in the accumulator tank;

a second refrigerant pipeline having a first end coupled to a midway portion of the first refrigerant pipeline and a second end coupled to the back pressure pipeline through a first valve;

a third refrigerant pipeline having a first end coupled to a midway portion of the refrigerant discharge pipe and second end coupled to the back pressure pipe through a second valve; and a controller coupled to the motor and configured to control a rotating speed of said motor and said first and second rollers, said controller also configured to operate said first and second valves, wherein said controller is configured to operate in a first mode of operation and open the first valve unit and close the second valve unit to cause the second refrigerant pipeline to communicate with the back pressure pipeline such that a part of the suction side refrigerants of the first and second rotary compressing elements, which flow in the first refrigerant pipeline and flow into the accumulator tank, enter the second refrigerant pipeline and flow into the back pressure chamber formed on the back surface side of the second vane through the back pressure pipeline, whereby suction side pressures of both of the first and second rotary compressing elements are applied as the back pressure of the second vane, and wherein said controller is configured to operate in a second mode of operation and close the first valve unit and open the second valve unit to cause the refrigerant discharge pipe and the back pressure pipeline to communicate with each other and a part of the discharge side refrigerants of the first and second rotary compressing elements, which are discharged from the closed vessel and pass through the refrigerant discharge pipe, pass through the third refrigerant pipeline and flow into the back pressure chamber through the back pressure pipeline and the discharge side pressures of the first and second rotary compressing elements are applied as the back pressure of the second vane.

2. A multicylinder rotary refrigerant gas compressor comprising:

a closed vessel;

a rotary compressing element provided in said closed vessel, said rotary compressing element including first and second compressing elements;

said first compressing element having a first cylinder with a first roller configured to rotate in said first cylinder and a first vane accommodated in a first guide groove formed in said first cylinder, said first vane being biased against said first roller by a spring member;

said second compressing element having a second cylinder with a second roller configured to rotate in said second cylinder and a second vane accommodated in a second guide groove formed in said second cylinder;

a motor operating element coupled to said first and second rollers, said motor operating element configured to rotate said first and second rollers;

a communicating pipe having one end opened into said closed vessel and an other end opened in a back pressure portion of the second vane;

a branch pipe having one end coupled to a mid portion of the communicating pipe;

a three-way valve attached to a branch point of the branch pipe;

a controller coupled to the motor operating element and configured to control a rotating speed of said motor operating element and said first and second rollers, said controller also configured to operate said three-way valve;

wherein said controller is configured to operate said motor operating element at a first rotating speed, and when operating at said first rotating speed, said controller configures said three-way valve to introduce refrigerant gas compressed by said rotary compressing element in said closed vessel through said communicating pipe to a back pressure portion of said second vane in said second rotary compressing element to press said second vane on said second roller whereby said second rotary compressing element in operation; and wherein said controller is configured to operate said motor operating element at a second rotating speed, said second rotating speed being less than said first rotating speed, and when said controller operates said motor operating element at the second rotating speed, said controller configures said three-way valve to relieve refrigerant gas compressed by said rotary compressing element in the closed vessel to said branch pipe through said communicating pipe thereby shutting off the introduction of refrigerant gas into the back pressure portion of the second vane and wherein said second vane is not pressed onto said second roller thereby operating only said first rotary compressing element.

3. A compressing system comprising:

a closed vessel;

a refrigerant discharge pipe having a first end inside of the closed vessel;

a driving element having a rotating shaft provided in said closed vessel;

first and second rotary compressing elements, driven by said driving element and said rotating shaft of said driving element, provided in said closed vessels;

said first rotary compressing element comprising a first cylinder, a first roller fitted in an eccentric portion formed in said rotating shaft, and which eccentrically rotates in said first cylinder, a first vane accommodated by a respective guide groove formed in said first cylinder, which abuts on the first roller to define the inside of said first cylinder between a low pressure chamber side and a high pressure chamber side to compress a refrigerant gas, said first vane being biased against said first roller by a spring member;

said second rotary compressing element comprising a second cylinder, a second roller fitted in an eccentric portion formed in said rotating shaft, and which eccentrically rotates in said second cylinder, a second vane accommodated by a respective guide groove formed in said second cylinder, which abuts on the second roller to define the inside of said second cylinder between a low pressure chamber side and a high pressure chamber side to compress a refrigerant gas, wherein the second rotary compressing element is not provided with a spring member that biases the second vane against said second roller;

wherein each of the first and second rotary compressing elements has a suction side input and a pressure side output;

a back pressure pipeline having a first end communicating with a back pressure chamber formed on a back surface side of the second vane;

an accumulator tank;

a first refrigerant pipeline having a first end inserted into an upper portion of the accumulator tank;

a second refrigerant pipeline having a first end coupled to a midway portion of the first refrigerant pipeline and a second end coupled to the back pressure pipeline through a first valve;

a third refrigerant pipeline having a first end coupled to a midway portion of the refrigerant discharge pipe and a second end coupled to the back pressure pipeline through a second valve;

a first refrigerant introduction pipe having a first end communicating with the suction side input of the first rotary compressing element and a second end opened in the accumulator tank;

a second refrigerant introduction pipe having a first end communicating through a third valve with the suction side input of the second rotary compressing element and a second end opened in the accumulator tank;

a controller coupled to the motor operating element and configured to control a rotating speed of said motor operating element and said first and second rollers, said controller also configured to operate said first, second and third valves;

wherein said controller is configured to operate in a first mode of operation to operate said motor operating element at a first rotating speed, and to open said third valve and close the first and second valves such that the refrigerant gas passes into the second cylinder and an intermediate pressure, which is reached by a flow of some amount of the refrigerant gas in the second cylinder from between the second vane and the guide groove into the back pressure portion connected to the back pressure pipeline between a suction side pressure and a discharge side pressure of the rotary compressing elements is applied as a back pressure to bias the second vane against the second roller.

4. The compressing system of claim 3, wherein:

said controller is further configured to operate in a second mode of operation wherein said controller operates said motor operating element at a second rotating speed, and opens the first valve and closes the second and third valves thus the inflow of the refrigerant gas into said second cylinder is blocked and a suction side pressure of said first rotary compressing element is applied as a back pressure of said second vane to be pressed to the back pressure portion side which is a side opposite to the second roller by a pressure of the refrigerant gas in said second cylinder being greater than a pressure of the refrigerant gas in a suction side of both of the first and second rotary compressing elements.

* * * * *

UNITED STATES PATENT AND TRADEMARK OFFICE

CERTIFICATE OF CORRECTION

PATENT NO. : 7,563,085 B2
APPLICATION NO. : 11/079929
DATED : July 21, 2009
INVENTOR(S) : Masazumi Sakaniwa et al.

It is certified that error appears in the above-identified patent and that said Letters Patent is hereby corrected as shown below:

Column 22, claim 3, line 51, "vessels" should read --vessel--.

Signed and Sealed this

Ninth Day of November, 2010

David J. Kappos

David J. Kappos
*Director of the United States Patent and Trademark Office*